US009333796B2

(12) United States Patent
Martin

(10) Patent No.: US 9,333,796 B2
(45) Date of Patent: May 10, 2016

(54) FINGERTIP MOUNTABLE WRITING INSTRUMENT

(71) Applicant: Keith Martin, Bethlehem, PA (US)

(72) Inventor: Keith Martin, Bethlehem, PA (US)

( * ) Notice: Subject to any disclaimer, the term of this patent is extended or adjusted under 35 U.S.C. 154(b) by 31 days.

(21) Appl. No.: 14/521,152

(22) Filed: Oct. 22, 2014

(65) Prior Publication Data

US 2015/0165813 A1 Jun. 18, 2015

Related U.S. Application Data

(60) Provisional application No. 61/894,462, filed on Oct. 23, 2013.

(51) Int. Cl.

| | |
|---|---|
| ***B43K 23/004*** | (2006.01) |
| ***B43K 8/02*** | (2006.01) |
| ***B43K 7/06*** | (2006.01) |
| ***B43K 7/10*** | (2006.01) |
| ***B43K 8/00*** | (2006.01) |
| ***B43K 8/03*** | (2006.01) |
| ***B43K 8/04*** | (2006.01) |
| ***B43K 19/00*** | (2006.01) |
| ***B43K 23/012*** | (2006.01) |
| ***B43K 23/016*** | (2006.01) |

(Continued)

(52) U.S. Cl.

CPC ..... *B43K 23/004* (2013.01); *B43K 5/005* (2013.01); *B43K 5/12* (2013.01); *B43K 5/18* (2013.01); *B43K 7/005* (2013.01); *B43K 7/06* (2013.01); *B43K 7/10* (2013.01); *B43K 8/003* (2013.01); *B43K 8/024* (2013.01); *B43K 8/03* (2013.01); *B43K 8/04* (2013.01); *B43K 19/00* (2013.01); *B43K 23/012* (2013.01); *B43K 23/016* (2013.01); *B43K 23/12* (2013.01); *Y10T 29/49826* (2015.01)

(58) Field of Classification Search

CPC ..... B43K 5/005; B43K 7/005; B43K 8/003; B43K 23/004; B43K 23/012; B43K 23/08; B25G 1/102; B43L 19/005

USPC ..... D19/158

See application file for complete search history.

(56) References Cited

U.S. PATENT DOCUMENTS 3,887,286 A 6/1975 Bucey
3,947,132 A 3/1976 Fox (Continued)

OTHER PUBLICATIONS http://www.globascope.com/wicowritingpen.html. Printed Oct. 21, 2013. 2 pages.

(Continued)

*Primary Examiner* — Mark A Laurenzi
*Assistant Examiner* — Bradley Oliver
(74) *Attorney, Agent, or Firm* — Joseph E. Maenner; Maenner & Associates, LLC

(57) ABSTRACT

A writing instrument is provided. The writing instrument includes a bifurcated body extending along a central axis. The body has a distal writing tip located on a first side of a tubular bifurcation and a proximal end located on a second side of the bifurcation, distal from the distal writing tip. The distal writing tip has a frustoconical end and a tubular portion extending proximally from the frustoconical end. The tubular portion has a circumferential ridge adjacent the frustoconical end. The bifurcation has a diameter larger than the diameter of the tubular portion. The proximal end includes a plurality of fingers extending proximally from the bifurcation. Each of the plurality of fingers is biased toward the central axis. A method of using the writing instrument is also provided.

12 Claims, 38 Drawing Sheets

(51) Int. Cl.

| | |
|---|---|
| ***B43K 23/12*** | (2006.01) |
| ***B43K 5/00*** | (2006.01) |
| ***B43K 5/12*** | (2006.01) |
| ***B43K 5/18*** | (2006.01) |
| ***B43K 7/00*** | (2006.01) |

(56) References Cited

U.S. PATENT DOCUMENTS

| | | | | |
|---|---|---|---|---|
| 4,986,682 | A | 1/1991 | Lu | |
| 5,405,206 | A | 4/1995 | Bedol | |
| 5,529,415 | A | 6/1996 | Bishop | |
| 5,944,433 | A | 8/1999 | O'Mara et al. | |
| 5,971,642 | A | 10/1999 | O'Mara et al. | |
| 6,527,464 | B2 | 3/2003 | Lee | |
| 6,648,537 | B1 | 11/2003 | Park | |
| 6,913,406 | B1 | 7/2005 | Nocerino | |
| 7,476,043 | B1 | 1/2009 | Rivas | |
| 7,722,271 | B1 | 5/2010 | Harvin | |
| 2011/0123253 | A1 * | 5/2011 | Matsui | B43K 23/012 401/269 |

OTHER PUBLICATIONS

Twisted photo. Downloaded Oct. 21, 2013. 1 page.

* cited by examiner

FINGERTIP MOUNTABLE WRITING INSTRUMENT

CROSS-REFERENCE TO RELATED APPLICATION

The present application claims priority from U.S. Provisional Patent Application Ser. No. 61/894,462, filed on Oct. 23, 2013, which is incorporated by reference herein in its entirety.

BACKGROUND OF THE INVENTION

Writing implements typically require the user to grasp the implement between the thumb and two adjacent fingers, requiring the application of relatively fine motor skills. Some persons suffering from physical disabilities, such as, for example, stroke victims, do not have these required fine motor skills. Additionally, young children may not have yet developed the skills.

It would be beneficial to provide a writing implement that allows users without fine motor skills to be able to use.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Briefly, the present invention provides a writing instrument including a bifurcated body extending along a central axis. The body has a distal writing tip located on a first side of a tubular bifurcation and a proximal end located on a second side of the bifurcation, distal from the distal writing tip. The distal writing tip has a frustoconical end and a tubular portion extending proximally from the frustoconical end. The tubular portion has a circumferential ridge adjacent the frustoconical end. The bifurcation has a diameter larger than the diameter of the tubular portion. The proximal end includes a plurality of fingers extending proximally from the bifurcation. Each of the plurality of fingers is biased toward the central axis.

Further, the present invention provides a method of using the writing instrument described above.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
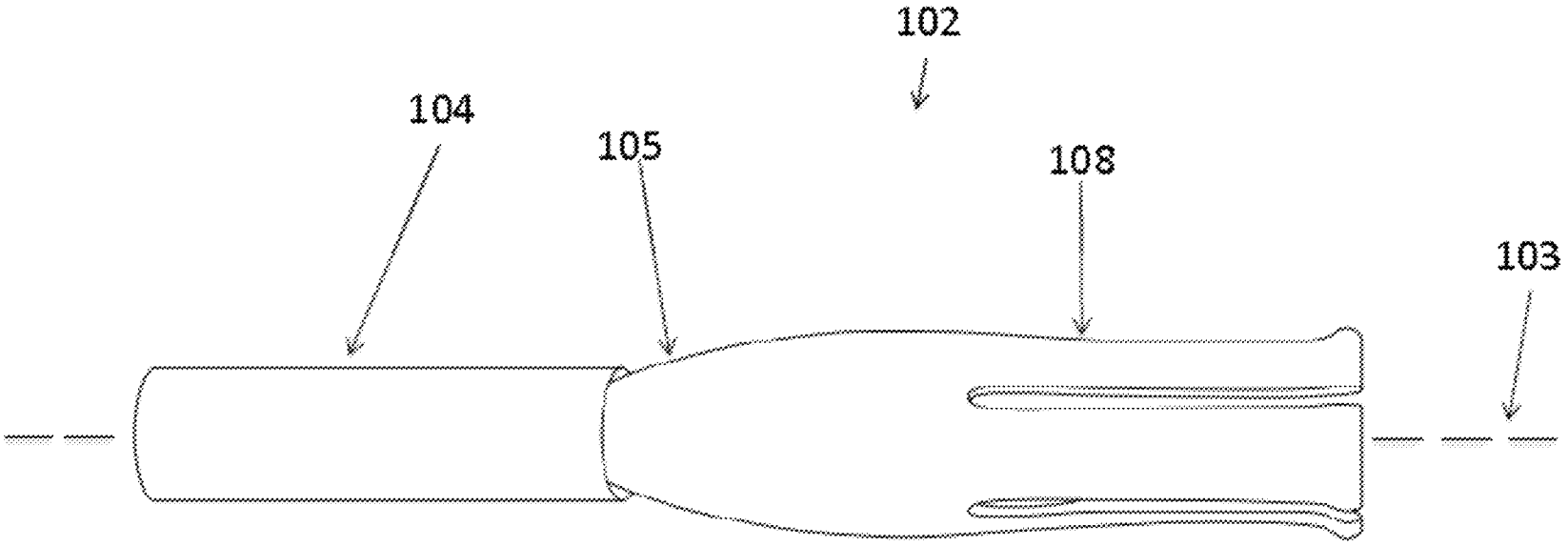
FIG. 1 is a side elevational view of a fingertip mountable writing instrument according to a first exemplary embodiment of the present invention.
Figure 2:
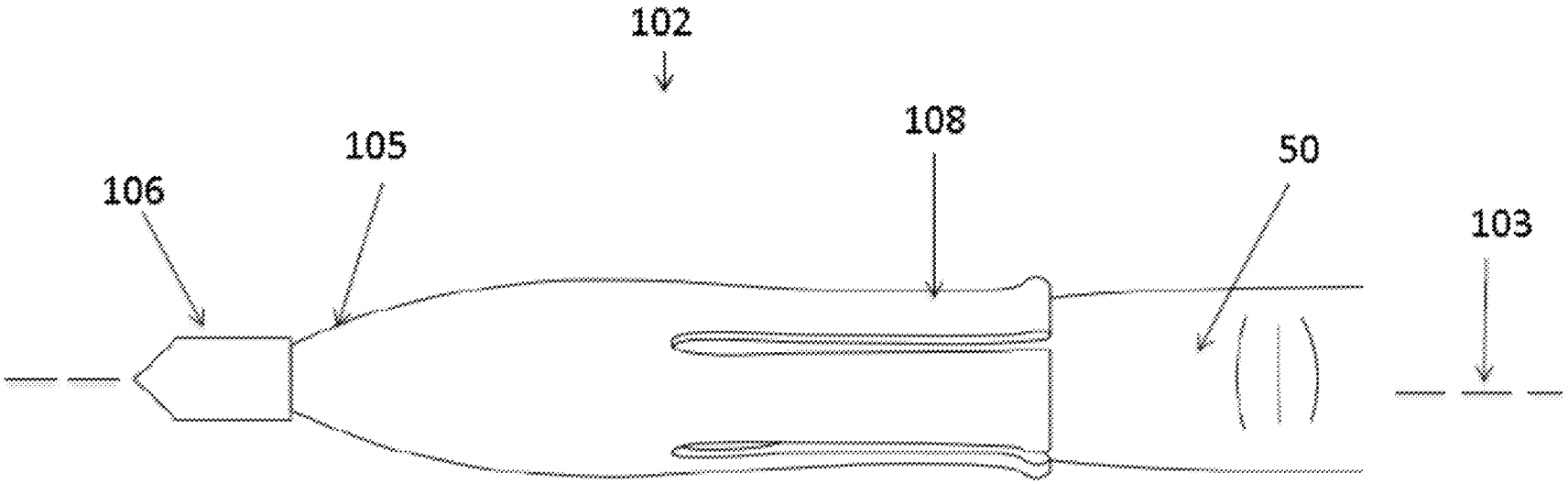
FIG. 2 is a side elevational view of the fingertip mountable writing instrument shown in FIG. 1 with a cap removed and a user's finger inserted therein.

In the drawings, like numerals indicate like elements throughout. Certain terminology is used herein for convenience only and is not to be taken as a limitation on the present invention. The terms "bottom end" and "top-end" refer, respectively, to the writing end and the insertion end of a fingertip mountable writing instrument according to the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments.

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

The present invention is a writing instrument that can be inserted over user's finger for writing. Such a writing instrument is highly useful especially for children or people with different wrist, arm, hand, or finger pain. The present invention provides that the writing instrument may reduce stress on the fingers while writing, which in turn may relieve and reduce arthritic pain or cramping related to writing. In addition, users suffering from different issues such as tendonitis, dystonia, repetitive stress injuries, carpal tunnel syndrome, and other illnesses or physical ailments, deformities, or disabilities may have the ability to write with a lot less pain and suffering and may be able to write more steadily.

Worn individually upon a finger, the writing instrument fits approximately up to the knuckle of the user. Because the fingers of different individuals vary in thickness, width, and length, it is contemplated, as one aspect of this invention that various sizes of fingertip writing instruments be made. Thus, there could be small, medium, and large sizes available, permitting the user to choose the size writing instrument, which more adequately gives the proper fit and comfort, although the design of the invention is one which attempts to be as close to one size fits all as possible.

Operation of the inventive device most readily achieved by having a fingertip implement of sufficient elongation that a substantial portion of the finger is inserted into the writing instrument so that the press fit occurs over a larger surface and thereby securely mounts the writing instrument on the user's finger.

Referring now to FIGS. 1-6, a first exemplary embodiment of a fingertip mountable writing instrument 100 according to the present invention is shown. Writing instrument 100 includes a generally elongate body 102 having a longitudinal axis 103 extending therethrough. Writing instrument 100 also has a removable cap 104 located at a bottom end 105 of body 102. As shown FIG. 2, upon removal of cap 104 from body 102, a writing tip 106 is provided at bottom end 105 of body 102. Further, body 102 also has a top end 108 such that a user can insert a finger 50 into top end 108 of body 102 so that the user can place the writing tip 106 against a writing surface, such as, for example, a sheet of paper (not shown), and, by manipulating finger 50, write on the writing surface.

Referring specifically to FIGS. 3-6, body 102 is a generally elongated tubular shell having an ink reservoir portion 110, ending in bottom end 105 and a finger engagement portion 112 into which the user's finger 50 (shown FIG. 2) is inserted to use writing instrument 100. Bottom end 105 retains writing tip 106 thereon.

Ink reservoir portion 110 houses an ink reservoir (not shown) containing ink that diffuses from the reservoir to writing tip 106 via capillary action and/or gravity for writing. Ink reservoir portion 110 has a generally convex shape, although, as will be seen in additional embodiments, ink reservoir portion 110 can have other shapes as well.

Finger engagement portion 112 includes a plurality of finger engagement members 114 that extend radially around the circumference of finger engagement portion 112. In writing instrument 100, five finger engagement members 114 are spaced generally evenly around the circumference of finger engagement portion 112. Those skilled in the art, however, will recognize that more or less than five finger engagement members 114 can be used. In an exemplary embodiment, finger engagement portion 114 extends about 40% of the total length of body 102.

Figure 3:
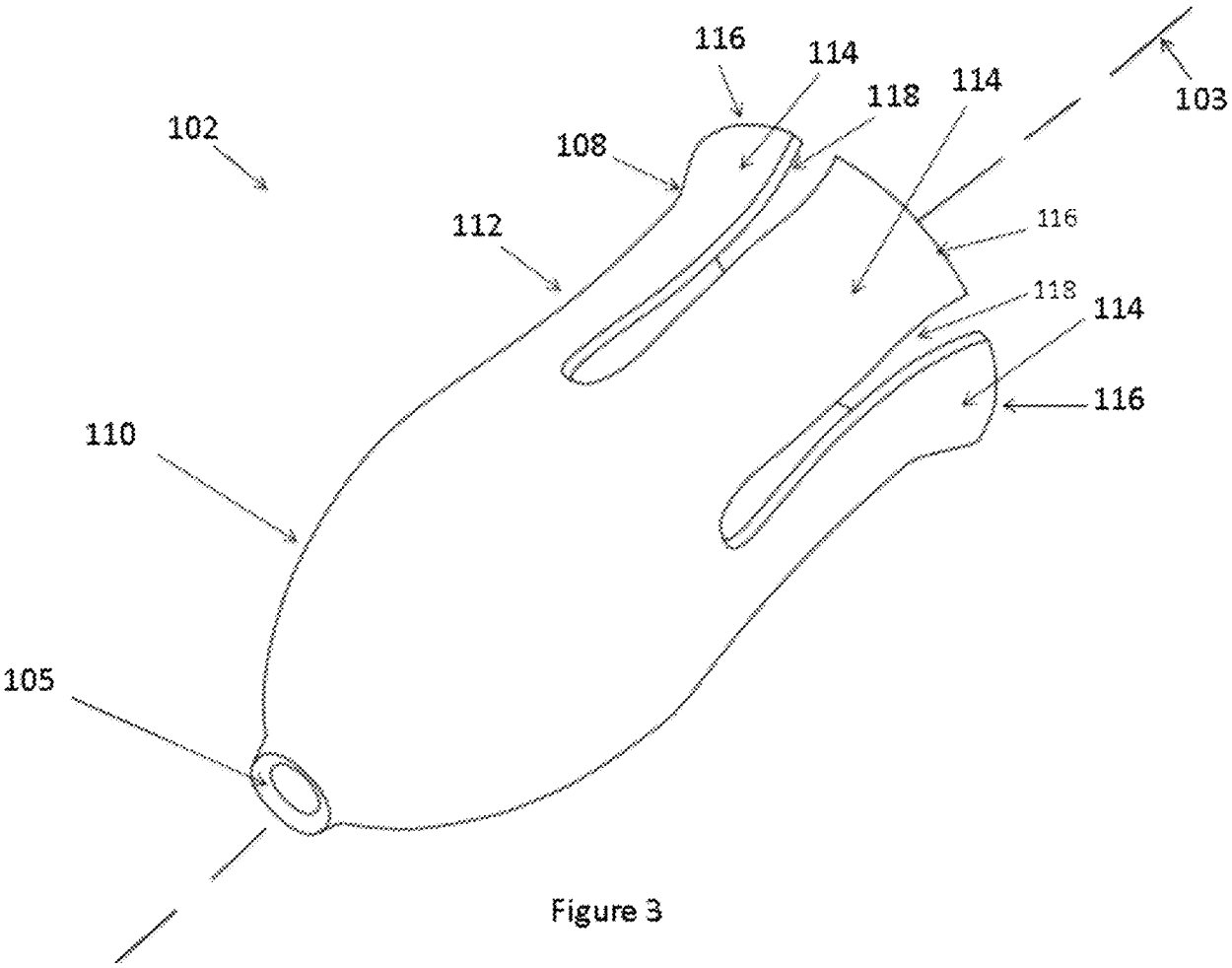
FIG. 3 is a bottom perspective view of the body of the fingertip mountable writing instrument shown in FIG. 1.
Figure 4:
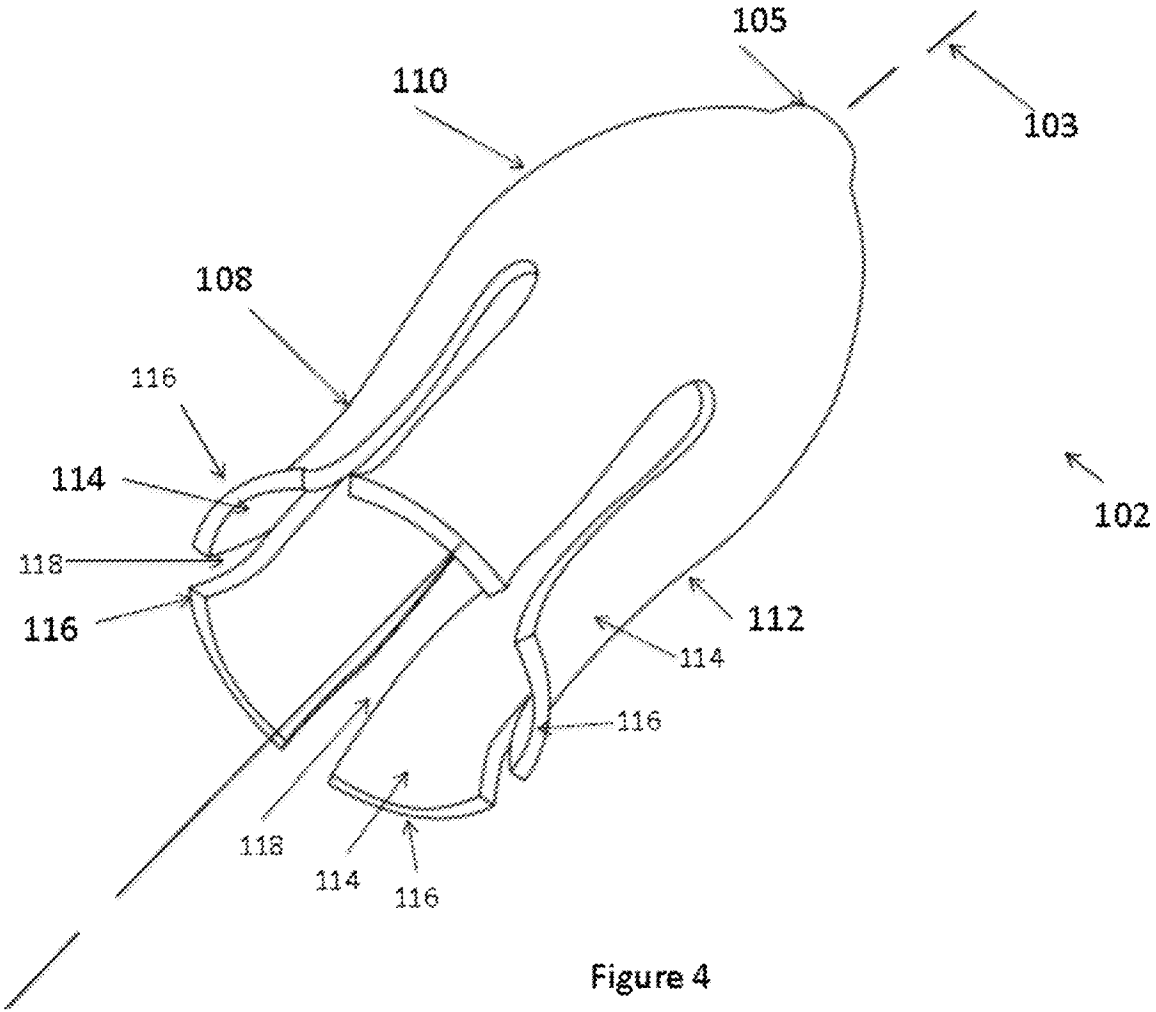
FIG. 4 is a top perspective view of the body of the fingertip mountable writing instrument shown in FIG. 1.
Figure 5:
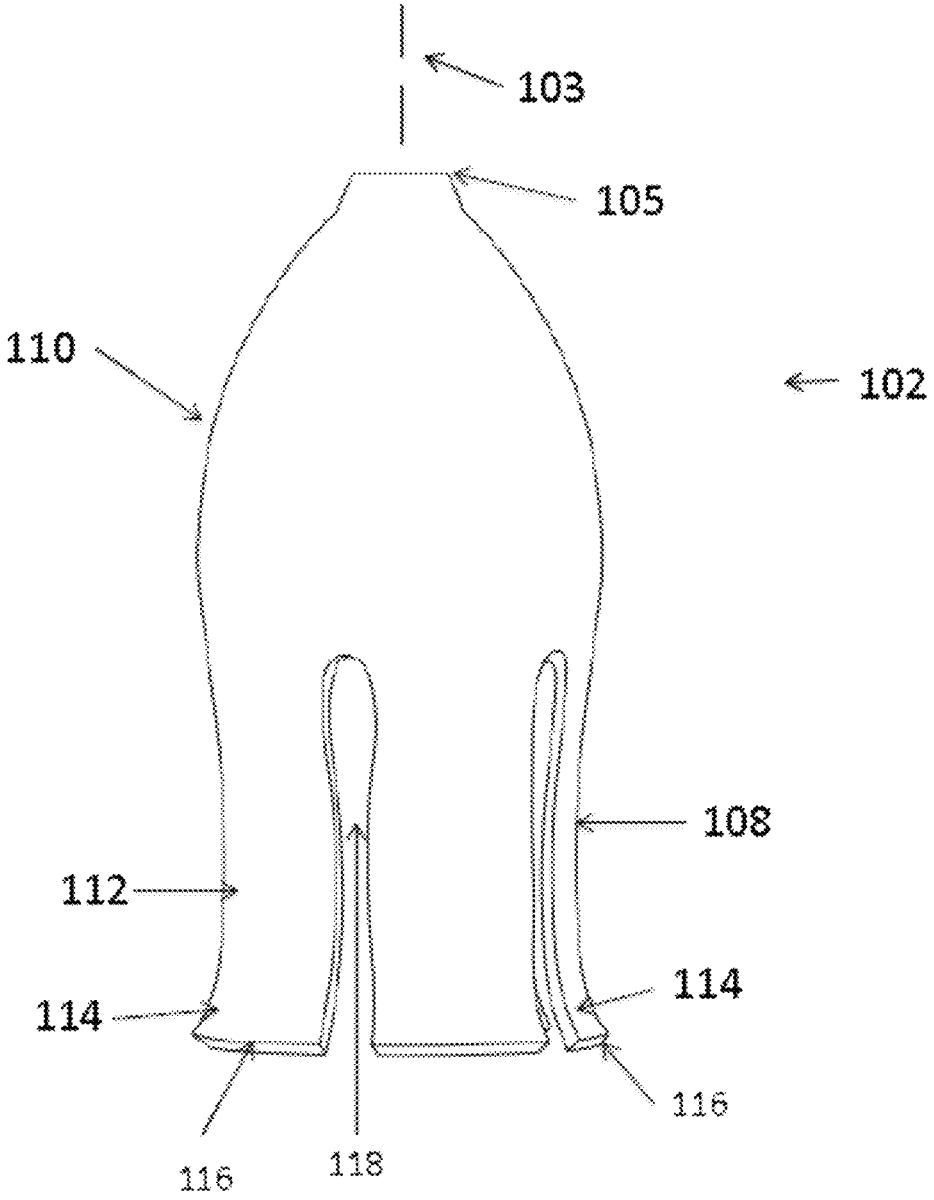
FIG. 5 is a side elevational view of the body of the fingertip mountable writing instrument shown in FIG. 1.
Figure 6:
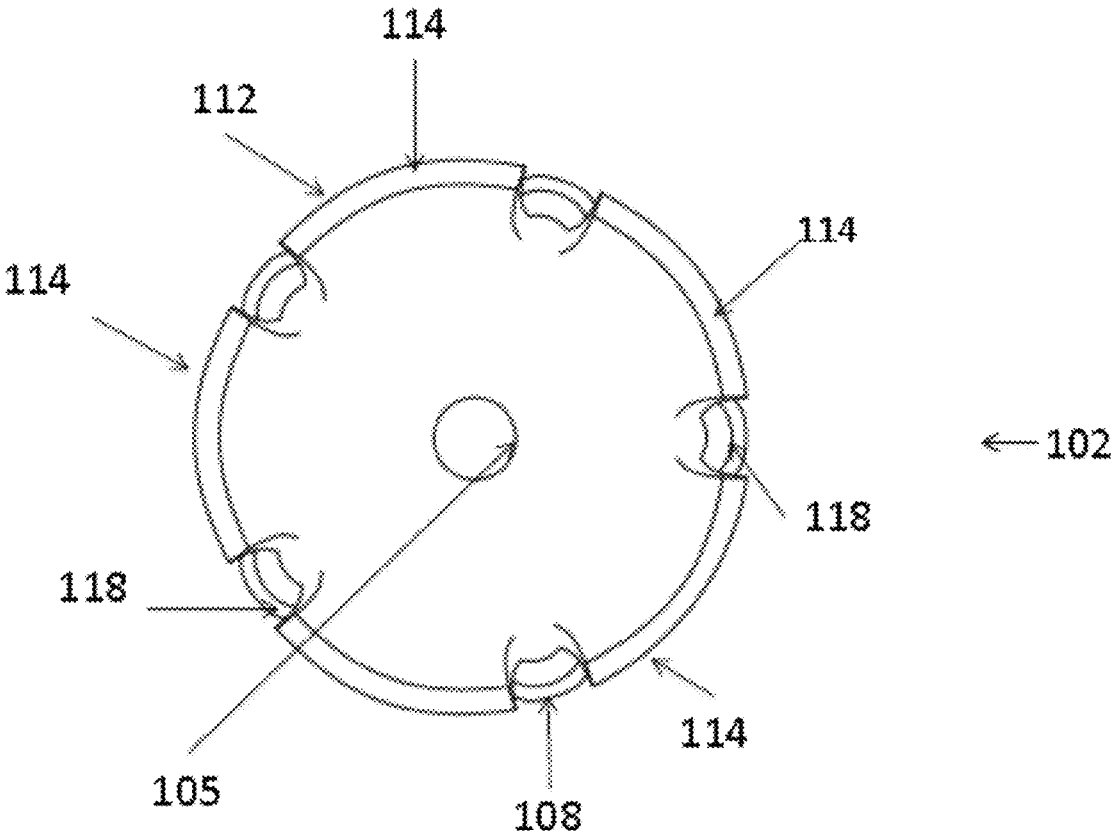
FIG. 6 is an end elevational view of the body of the fingertip mountable instrument shown in FIG. 1.
Figure 7:
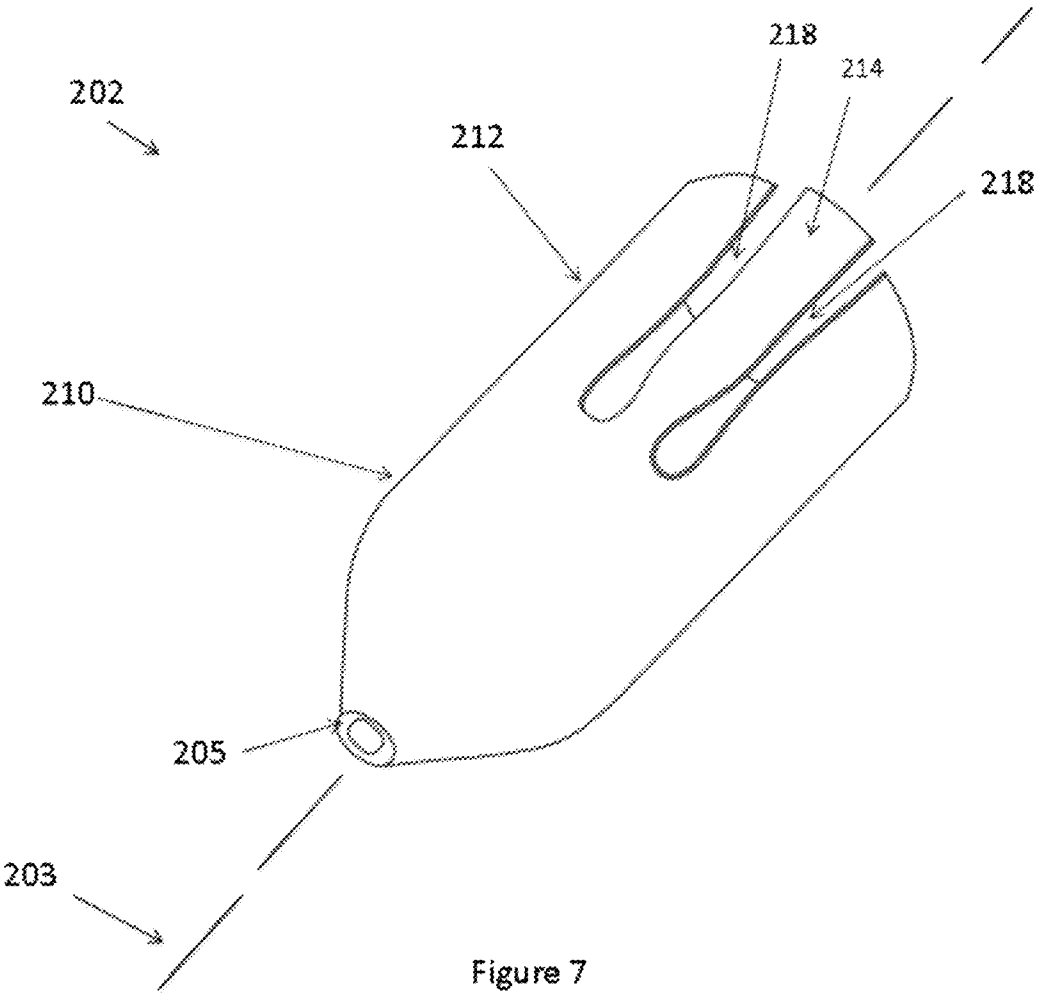
FIG. 7 is a bottom perspective view of the body of a fingertip mountable writing instrument according to a second exemplary embodiment of the present invention.

As shown FIG. 5, ink reservoir portion 110 extends slightly farther outwardly from longitudinal axis 103 than finger engagement portion 112. As shown in FIGS. 3-5, the top end 116 of each finger engagement member 114 is flared outwardly away from longitudinal axis 103. The outward flare facilitates insertion of finger 50 into finger engagement portion 112. Adjacent finger engagement members 114 are separated from each other by a gap 118 that allows each finger engagement member 114 to be biased outwardly, away from longitudinal axis 103, to allow a finger 50 that is larger than the space inside finger engagement portion 112 to bias finger engagement members 114 outwardly and grip finger 50. The five finger engagement members 114 provide sufficient force to grip finger 50, but do not grip finger 50 so tight as to cause pain to finger 50.

The material from which body 102 may be constructed can be a transparent or translucent material, such as, for example, a plastic-type resin so that the user may be able to view the inside of body 102 to see how much ink is remaining in the ink reservoir. Alternatively, body 102 can be opaque and manufactured in various colors that represent respective ink colors within body 102.

While writing tip 106, is shown as being a felt tip, those skilled in the art will recognize that other types of writing tips, such as, for example, ballpoint tips, may be used within the spirit and scope of this invention. Additionally, tip 106 can be a marker, pencil, brush, crayon, chalk, stamp, stencil, or other writing implement.

Additionally, while the present invention is meant to be put on a finger, the inventive writing instrument can also be held like a regular writing instrument and written with in a normal, familiar fashion.

Alternative embodiments of the present invention are shown in the remaining figures. Those skilled in the art will recognize that the attributes of writing instrument 100, even if not specifically referred to with respect to the remaining alternative embodiments, are applicable to those embodiments as well.

A second exemplary embodiment of a body 202 for a fingertip mountable writing instrument is shown in FIGS. 7-10. Body 202 includes a longitudinal axis 203 extending therethrough.

Body 202 is a generally elongated tubular shell having an ink reservoir portion 210 ending in a bottom end 205 and a finger engagement portion 212 into which the user's finger is inserted to use the writing instrument. Bottom end 205 retains a writing tip (not shown) thereon.

Ink reservoir portion 210 houses an ink reservoir (not shown) containing ink that diffuses from the reservoir to the writing tip via capillary action and/or gravity for writing. Ink reservoir portion 210 has a generally conical shape.

Finger engagement portion 212 includes a single finger engagement member 214 that is separated from the remainder of finger engagement portion 212 by gaps 218 on either side of finger engagement member 214. In an exemplary embodiment, finger engagement portion 214 extends about 50% of the total length of body 202.

Figure 8:
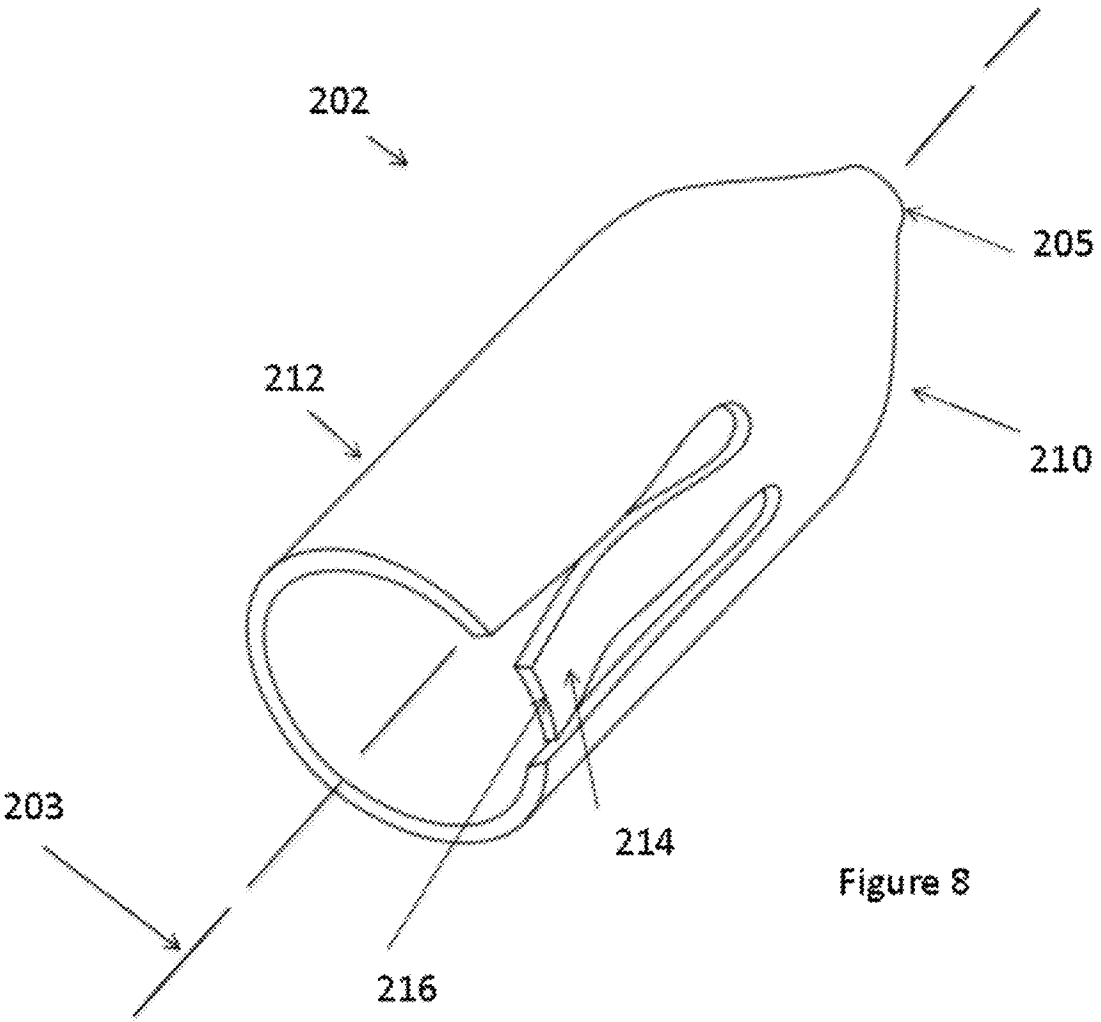
FIG. 8 is a top perspective view of the body of the fingertip mountable instrument shown in FIG. 7.
Figure 9:
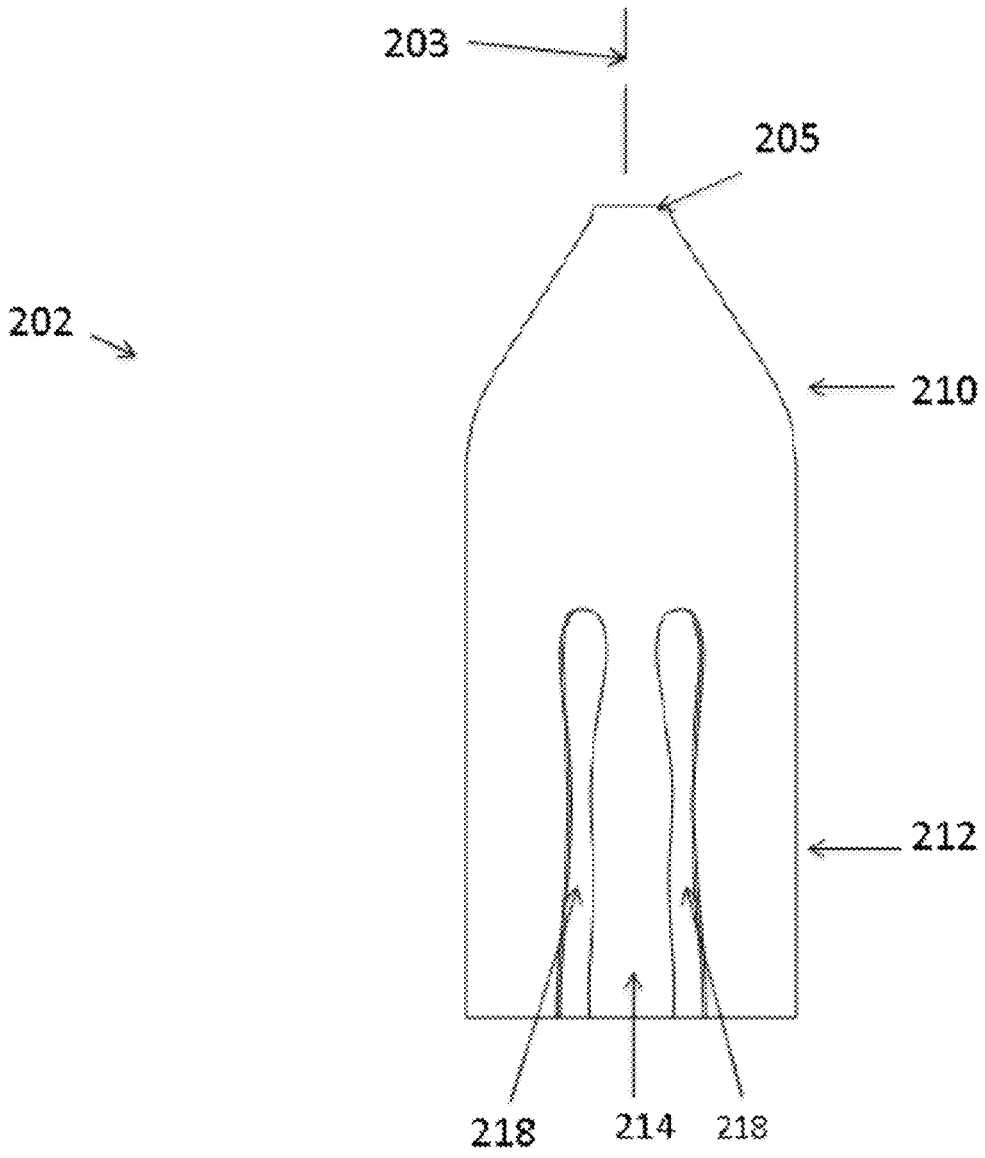
FIG. 9 is a side elevational view of the body of the fingertip mountable instrument shown in FIG. 7.
Figure 10:
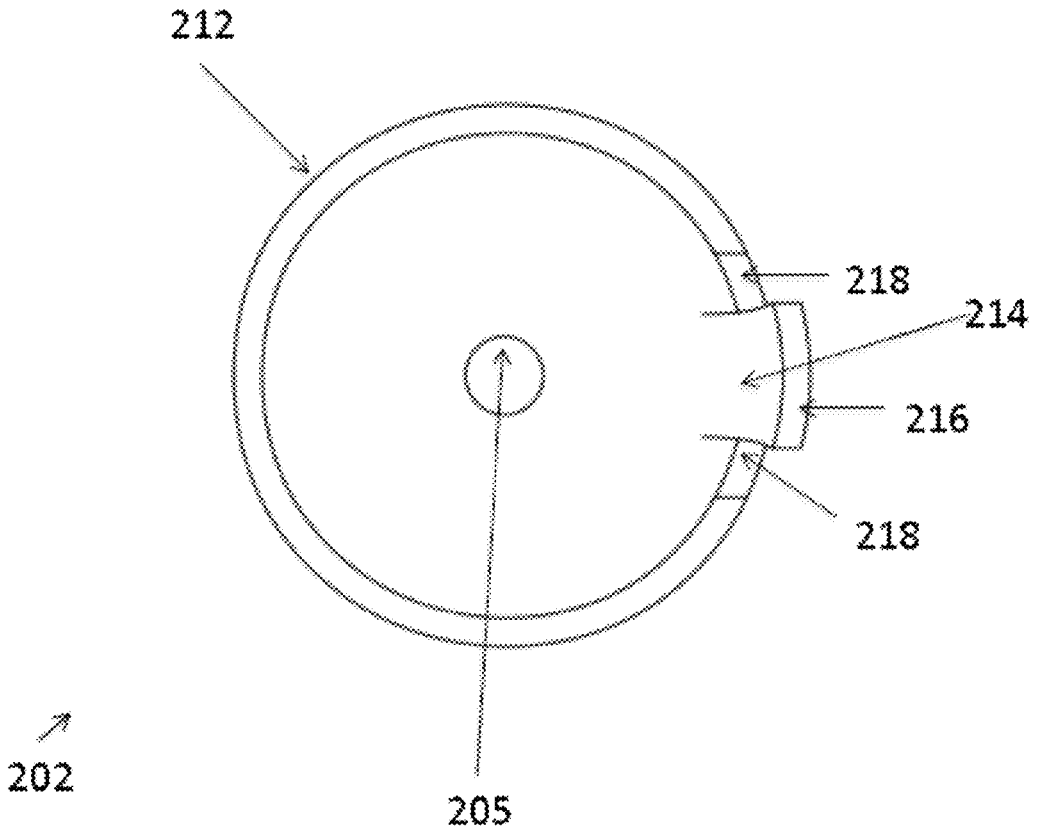
FIG. 10 is an end elevational view of the body of the fingertip mountable instrument shown in FIG. 7.

As shown in FIGS. 8 and 10, the top end 216 of finger engagement member 214 is flared outwardly away from longitudinal axis 203. The outward flare facilitates insertion of a finger into finger engagement portion 212. Gaps 218 allow a finger that is larger than the space inside finger engagement portion 212 to bias finger engagement member 214 outwardly and grip the finger. Finger engagement member 214 provides sufficient force to grip the finger, but does not grip the finger so tight as to cause pain to the finger.

A third exemplary embodiment of a body 302 for a fingertip mountable writing instrument is shown in FIGS. 11-14. Body 302 includes a longitudinal axis 303 extending therethrough.

Body 302 is a generally elongated tubular shell having an ink reservoir portion 310 ending in a bottom end 305 and a finger engagement portion 312 into which the user's finger is inserted to use the writing instrument. Bottom end 305 retains a writing tip (not shown) thereon. Bottom end 305 extends away from reservoir portion 310 along axis 303.

Ink reservoir portion 310 houses an ink reservoir (not shown) containing ink that diffuses from the reservoir to the writing tip via capillary action and/or gravity for writing. Ink reservoir portion 310 has a generally conical shape.

Finger engagement portion 312 includes a single finger engagement member 314 that is separated from the remainder of finger engagement portion 312 by gaps 318 on either side of finger engagement member 314. In an exemplary embodiment, finger engagement portion 314 extends about 50% of the total length of body 302.

Figure 11:
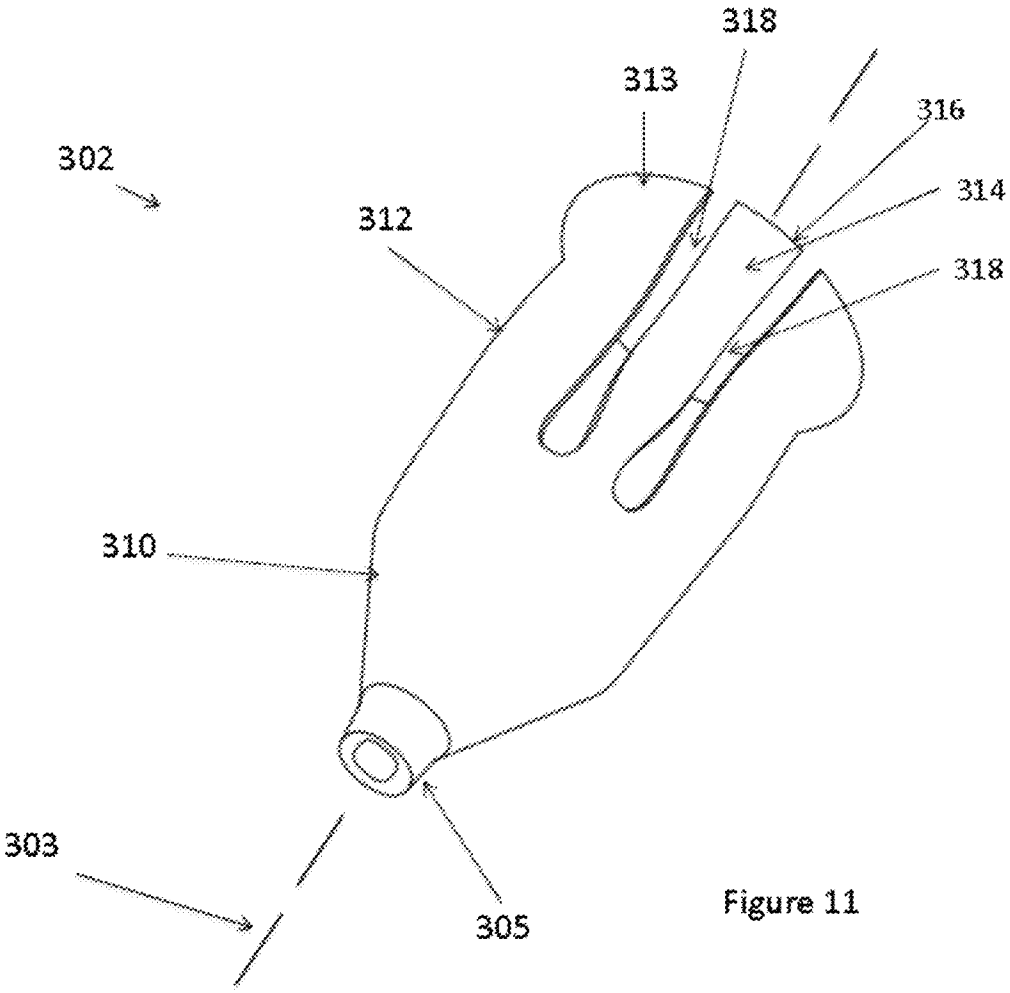
FIG. 11 is a bottom perspective view of the body of a fingertip mountable writing instrument according to a third exemplary embodiment of the present invention.
Figure 12:
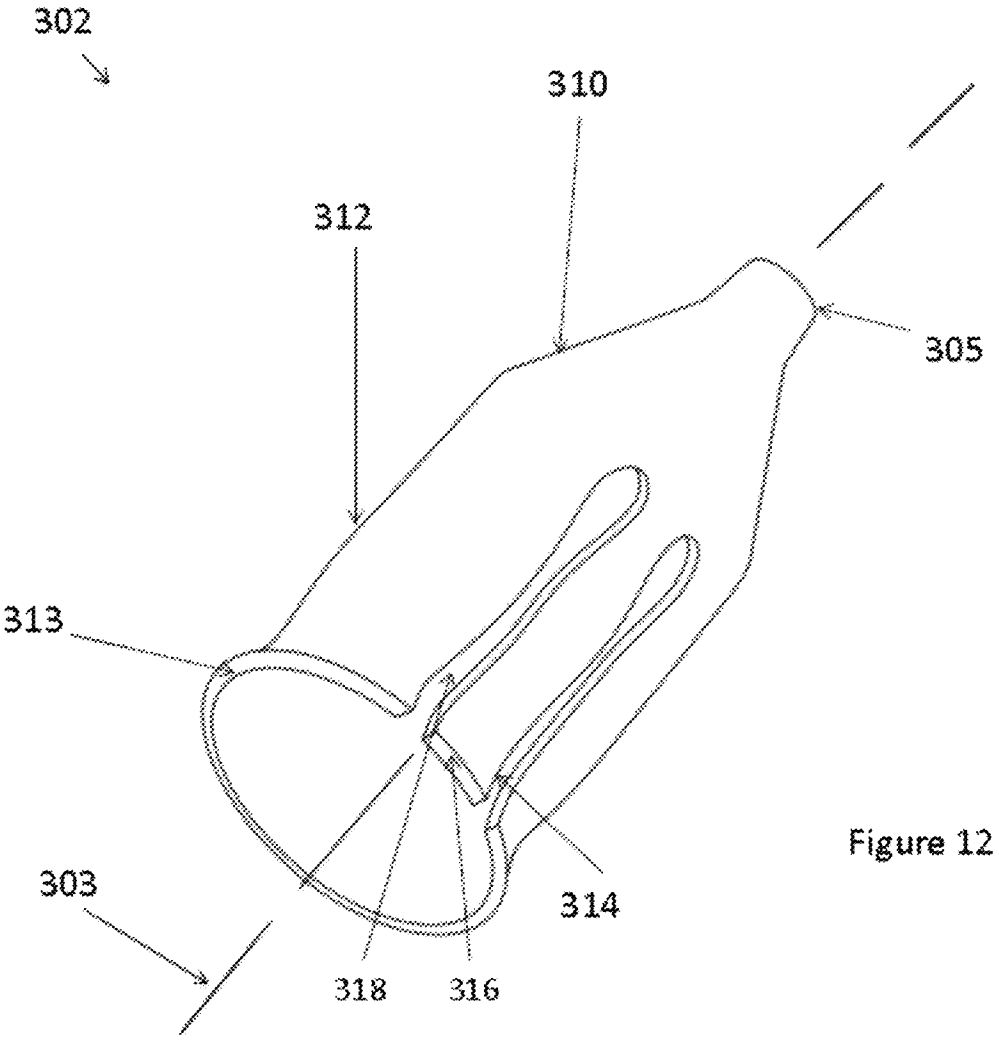
FIG. 12 is a top perspective view of the body of the fingertip mountable instrument shown in FIG. 11.
Figure 13:
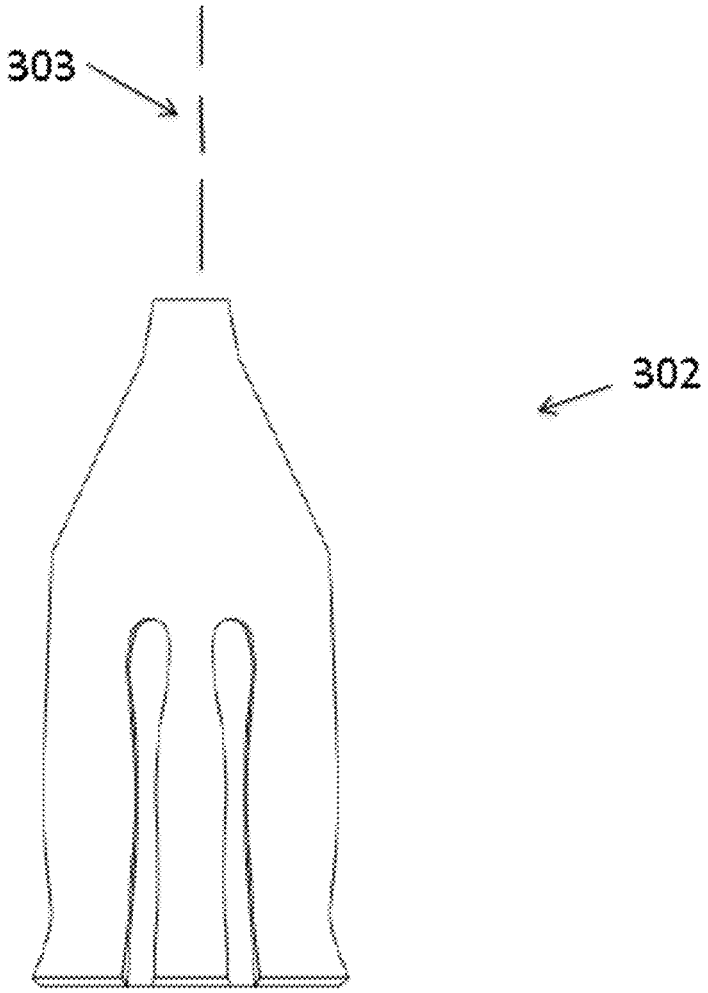
FIG. 13 is a side elevational view of the body of the fingertip mountable instrument shown in FIG. 11.
Figure 14:
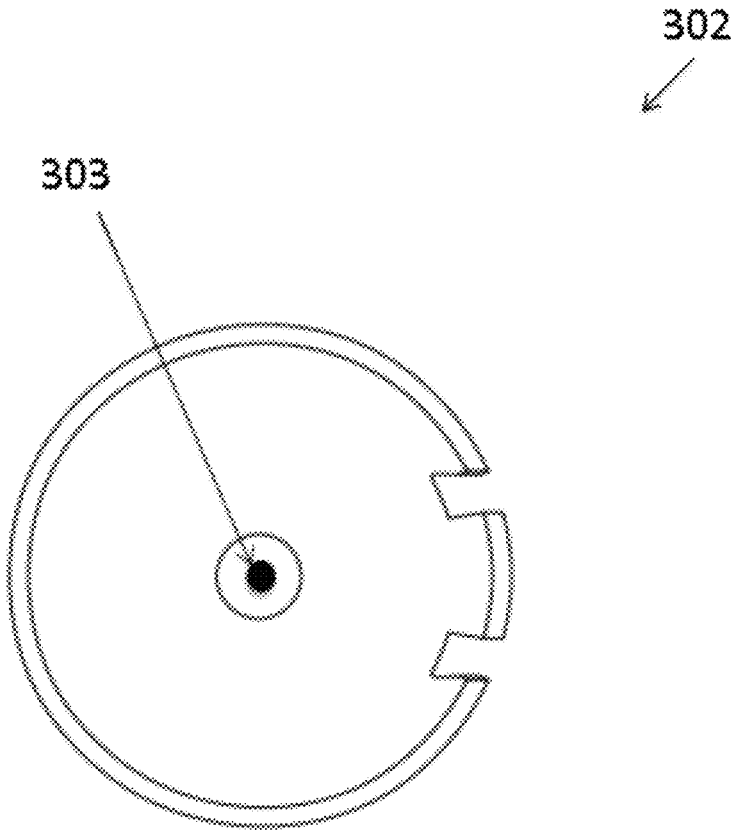
FIG. 14 is an end elevational view of the body of the fingertip mountable instrument shown in FIG. 11.

As shown in FIGS. 11-13, the top end 316 of finger engagement member 314 as well as the top end 313 of finger engagement portion 312 is flared outwardly away from longitudinal axis 303. The outward flares facilitate insertion of a finger into finger engagement portion 312. Gaps 318 allow a finger that is larger than the space inside finger engagement portion 312 to bias finger engagement member 314 outwardly and grip the finger. Finger engagement member 314 provides sufficient force to grip the finger, but does not grip the finger so tight as to cause pain to the finger.

A fourth exemplary embodiment of a body 402 for a fingertip mountable writing instrument is shown in FIGS. 15-18. Body 402 includes a longitudinal axis 403 extending therethrough.

Body 402 is a generally elongated tubular shell having an ink reservoir portion 410 ending in a bottom end 405 and a finger engagement portion 412 into which the user's finger is inserted to use the writing instrument. Bottom end 405 retains a writing tip (not shown) thereon. Bottom end 405 extends away from reservoir portion 410 along axis 403.

Ink reservoir portion 410 houses an ink reservoir (not shown) containing ink that diffuses from the reservoir to the writing tip via capillary action and/or gravity for writing. Ink reservoir portion 410 has a generally conical shape.

Finger engagement portion 412 includes a plurality of finger engagement members 414 that extend radially around the circumference of finger engagement portion 412. In this embodiment, eight finger engagement members 414 are spaced generally evenly around the circumference of finger engagement portion 412. Those skilled in the art, however, will recognize that more or less than eight finger engagement members 414 can be used. In an exemplary embodiment, finger engagement portion 414 extends about 25% of the total length of body 402.

Figure 15:
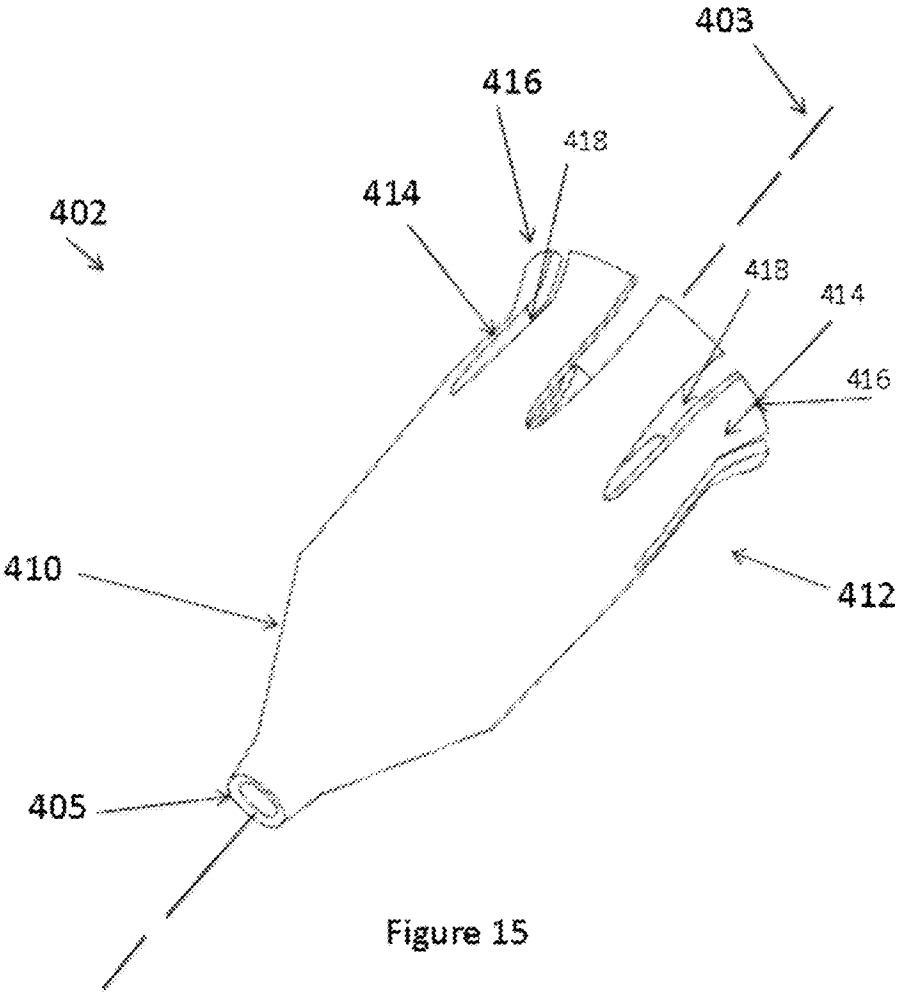
FIG. 15 is a bottom perspective view of the body of a fingertip mountable writing instrument according to a fourth exemplary embodiment of the present invention.
Figure 16:
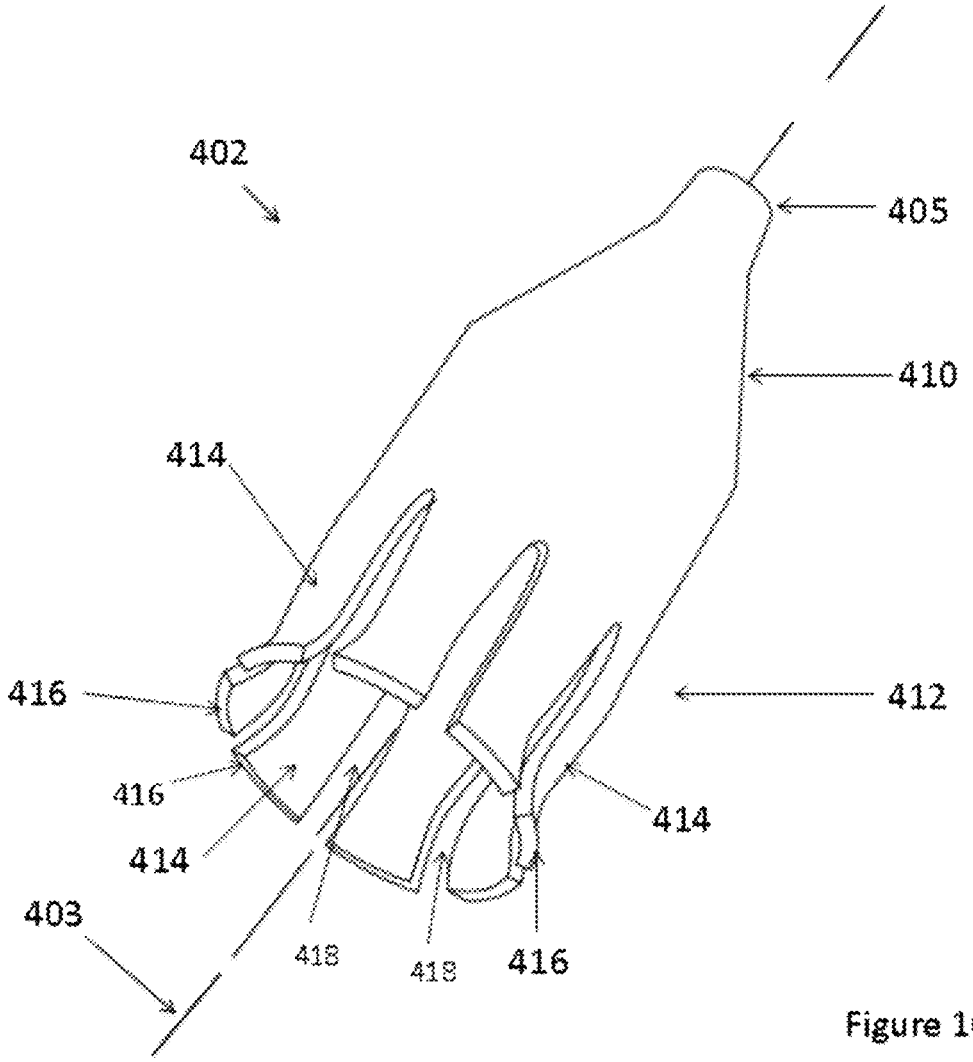
FIG. 16 is a top perspective view of the body of the fingertip mountable instrument shown in FIG. 15.
Figure 17:
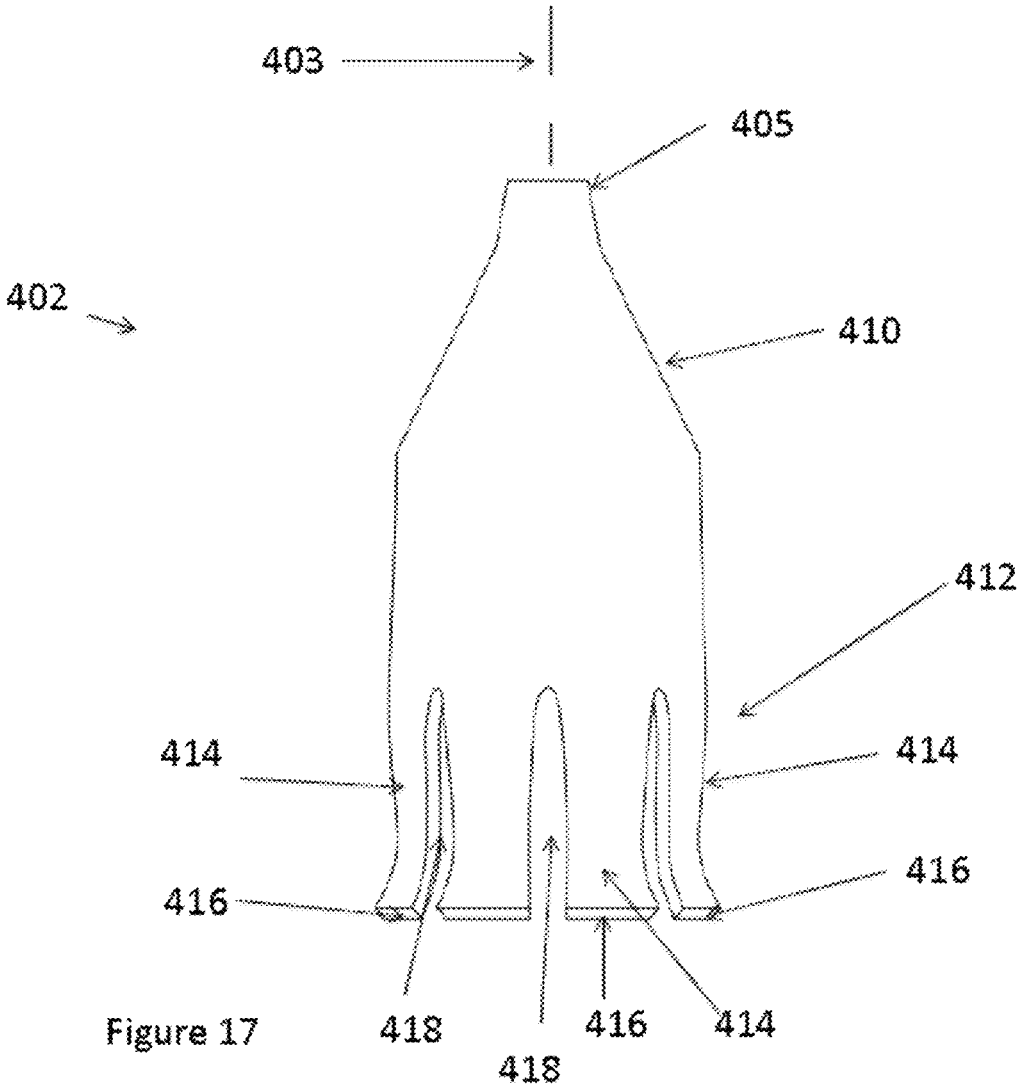
FIG. 17 is a side elevational view of the body of the fingertip mountable instrument shown in FIG. 15.
Figure 18:
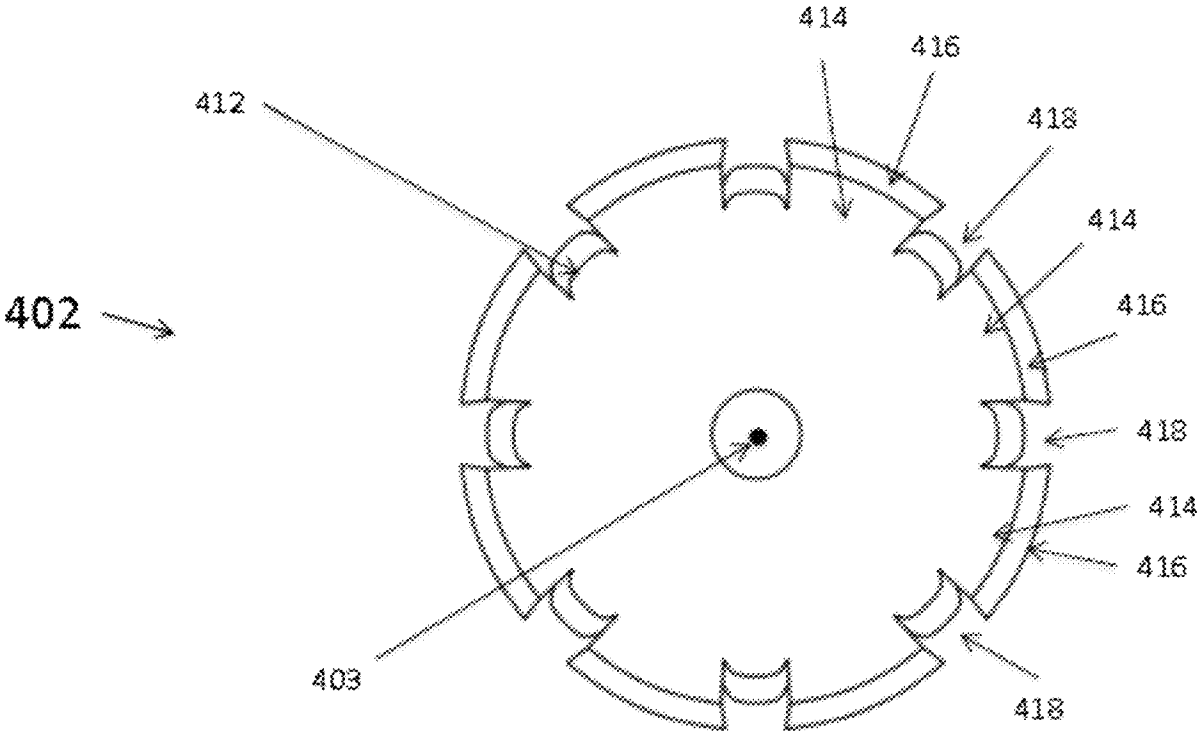
FIG. 18 is an end elevational view of the body of the fingertip mountable instrument shown in FIG. 15.
Figure 19:
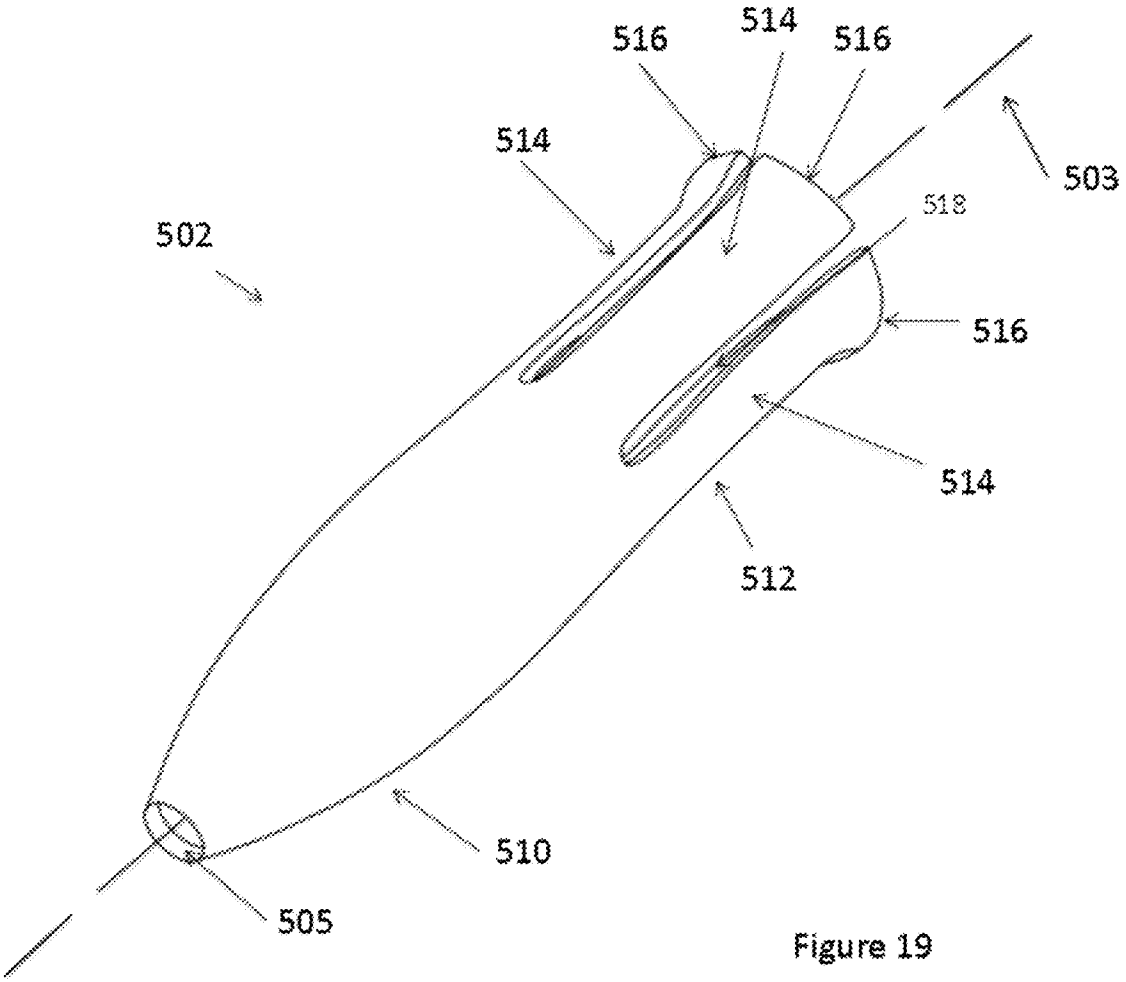
FIG. 19 is a bottom perspective view of the body of a fingertip mountable writing instrument according to a fifth exemplary embodiment of the present invention.
Figure 20:
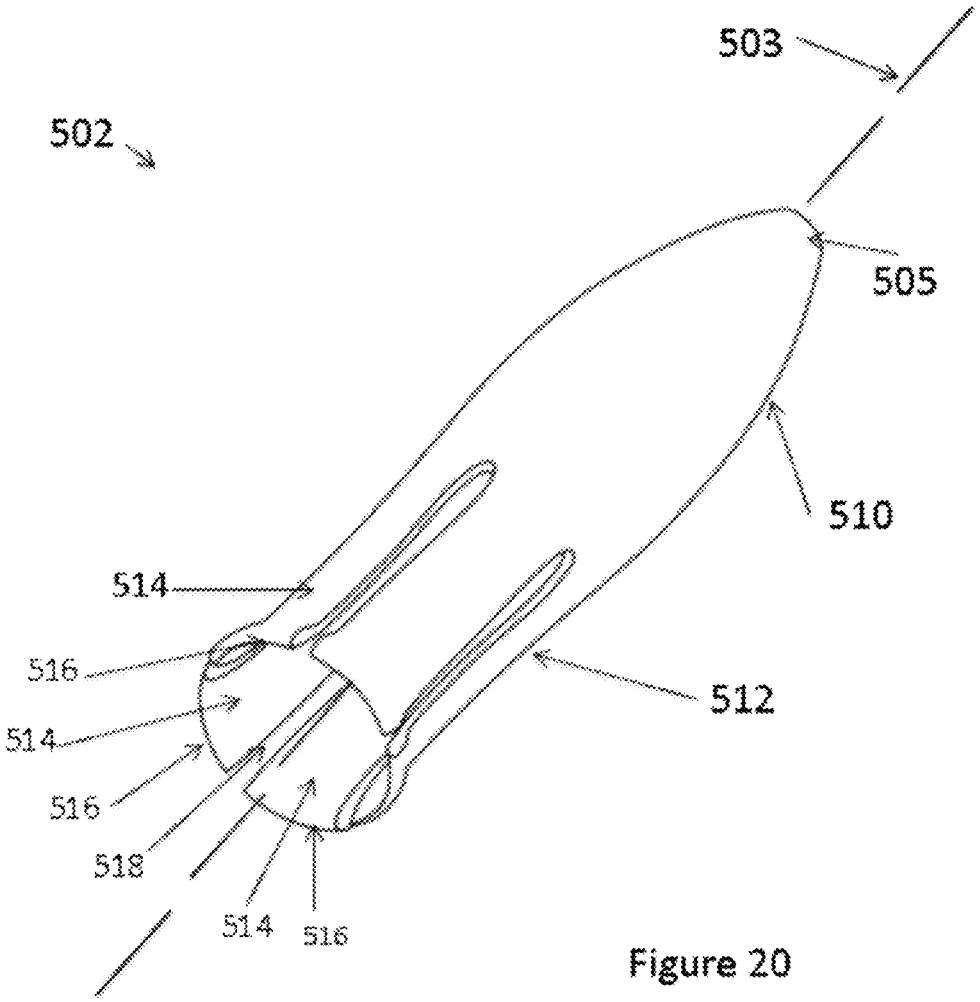
FIG. 20 is a top perspective view of the body of the fingertip mountable instrument shown in FIG. 19.
Figure 21:
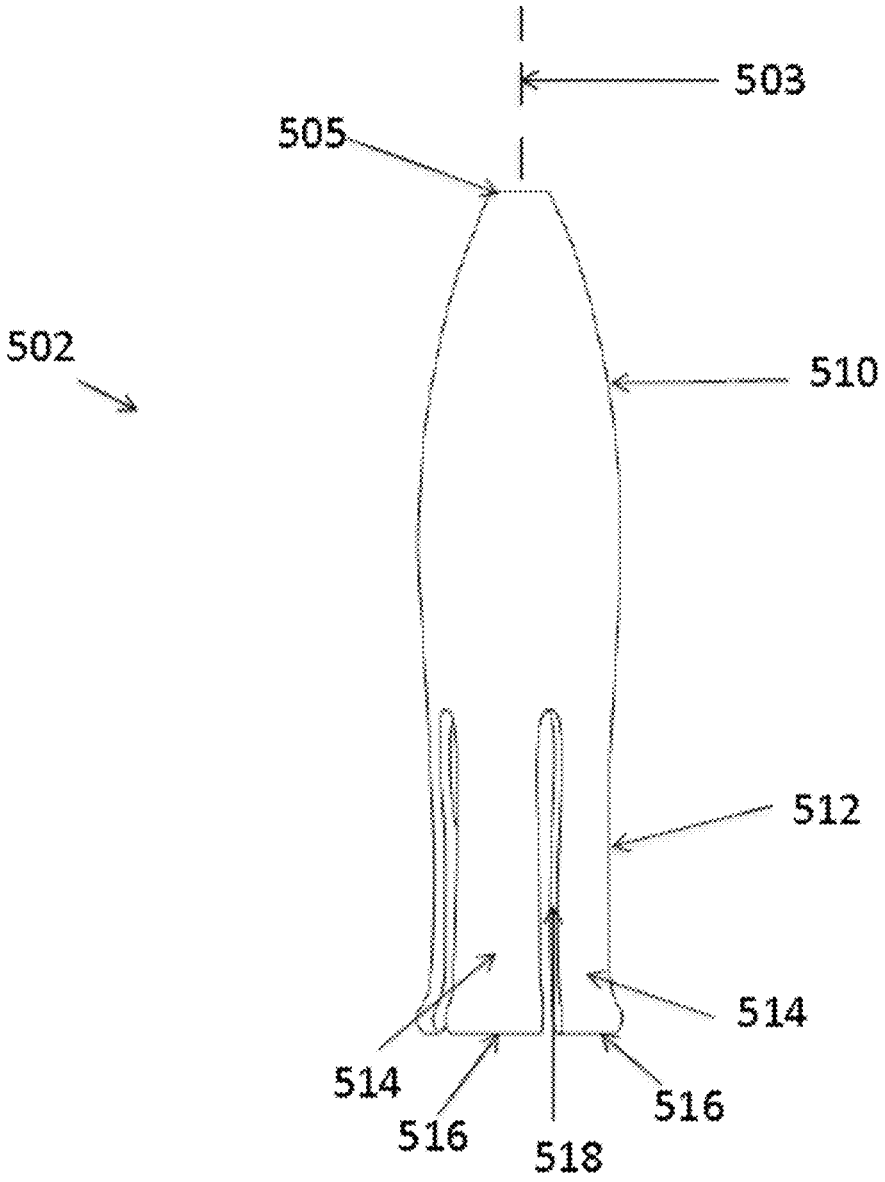
FIG. 21 is a side elevational view of the body of the fingertip mountable instrument shown in FIG. 19.
Figure 22:
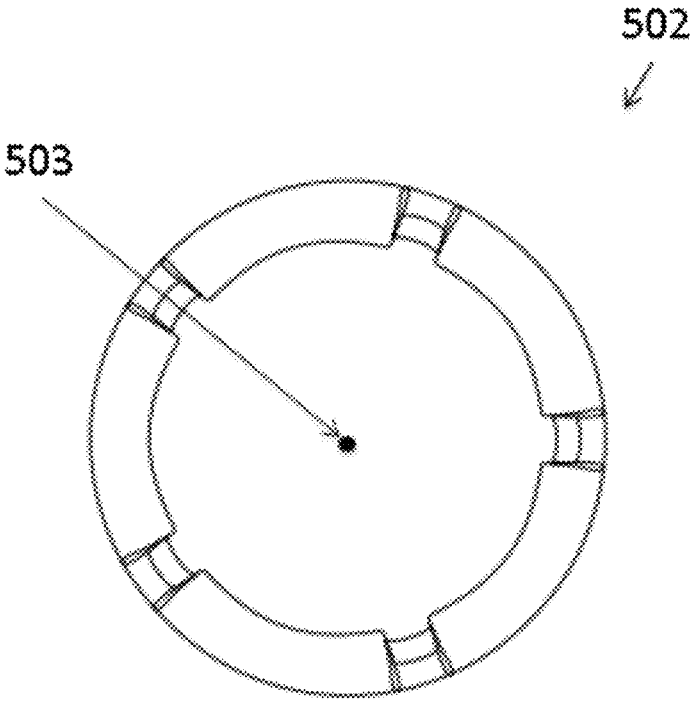
FIG. 22 is an end elevational view of the body of the fingertip mountable instrument shown in FIG. 19.

As shown in FIGS. 15-17, the top end 416 of each finger engagement member 414 is flared outwardly away from longitudinal axis 403. The outward flare facilitates insertion of a finger into finger engagement portion 412. Adjacent finger engagement members 414 are separated from each other by a gap 418 that allows each finger engagement member 414 to be biased outwardly, away from longitudinal axis 403, to allow a finger that is larger than the space inside finger engagement portion 412 to bias finger engagement members 414 outwardly and grip the finger. The eight finger engagement members 414 provide sufficient force to grip the finger, but do not grip the finger so tight as to cause pain to the finger.

A fifth exemplary embodiment of a body 502 for a fingertip mountable writing instrument is shown in FIGS. 19-23. Body 502 includes a longitudinal axis 503 extending therethrough.

Body 502 is a generally elongated tubular shell having an ink reservoir portion 510 ending in a bottom end 505 and a finger engagement portion 512 into which the user's finger is inserted to use the writing instrument. Bottom end 505 retains a writing tip (not shown) thereon.

Figure 23:
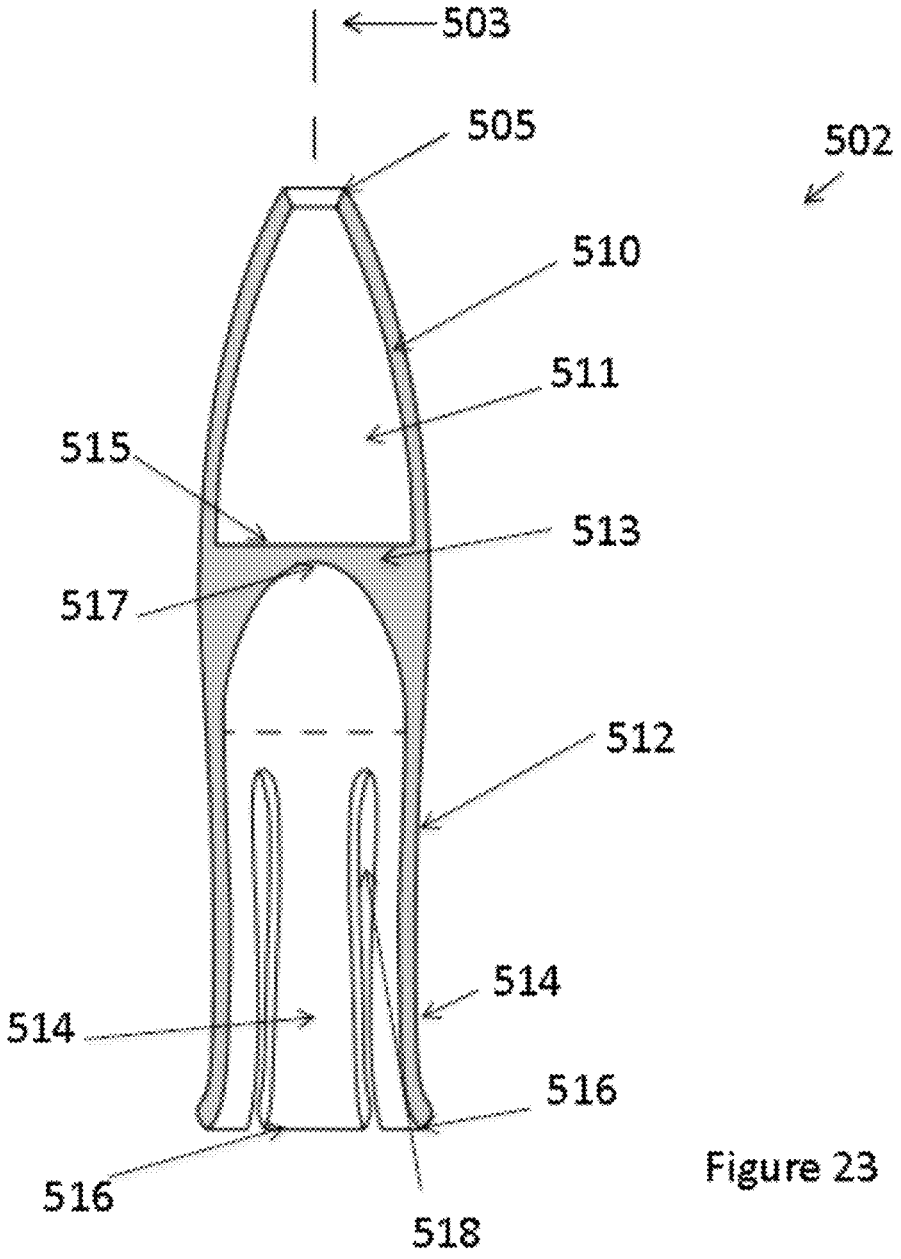
FIG. 23 is a sectional view of the body of the fingertip mountable instrument taken through Lines 23-23 of FIG. 21.
Figure 24:
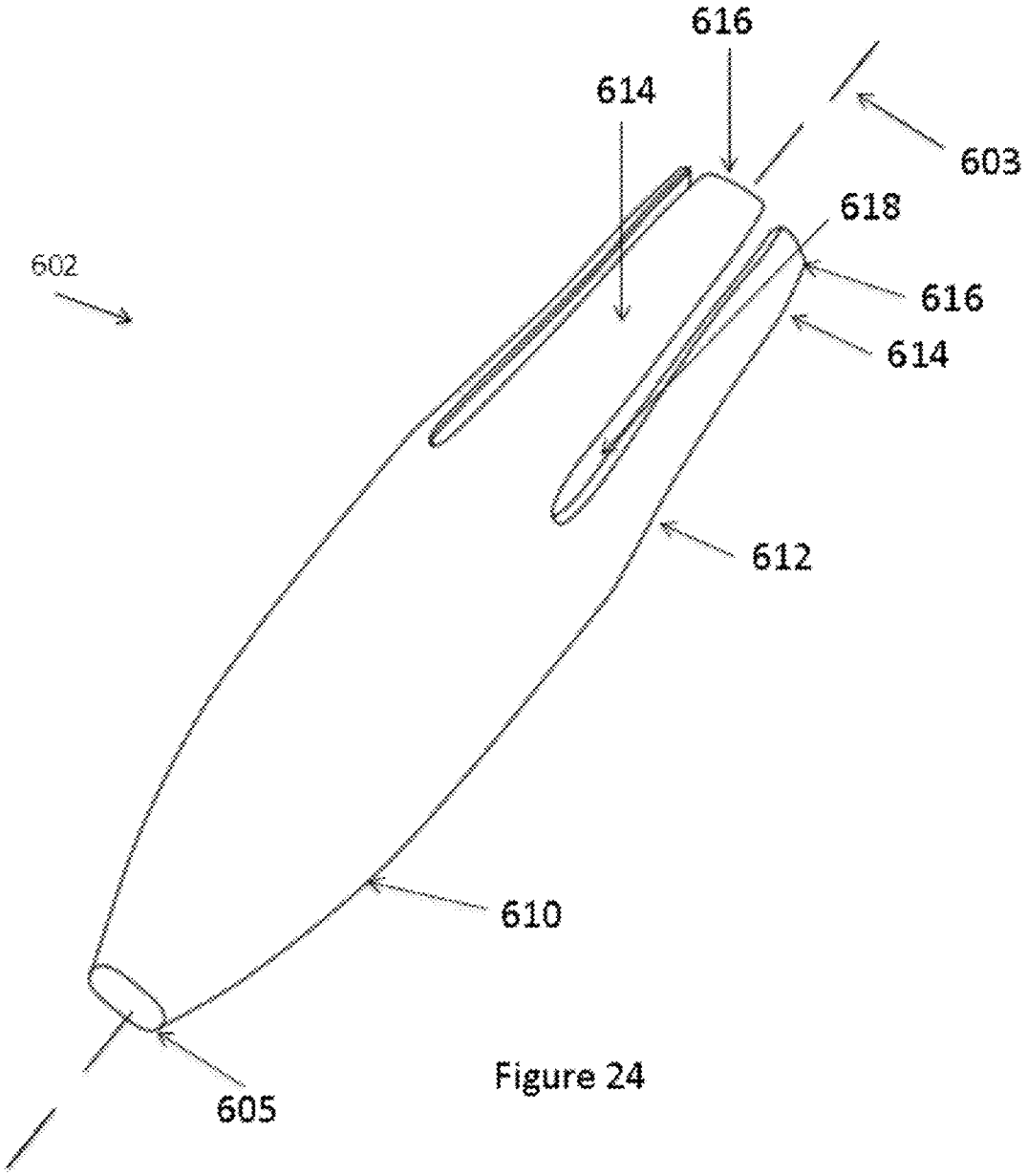
FIG. 24 is a bottom perspective view of the body of a fingertip mountable writing instrument according to a sixth exemplary embodiment of the present invention.
Figure 25:
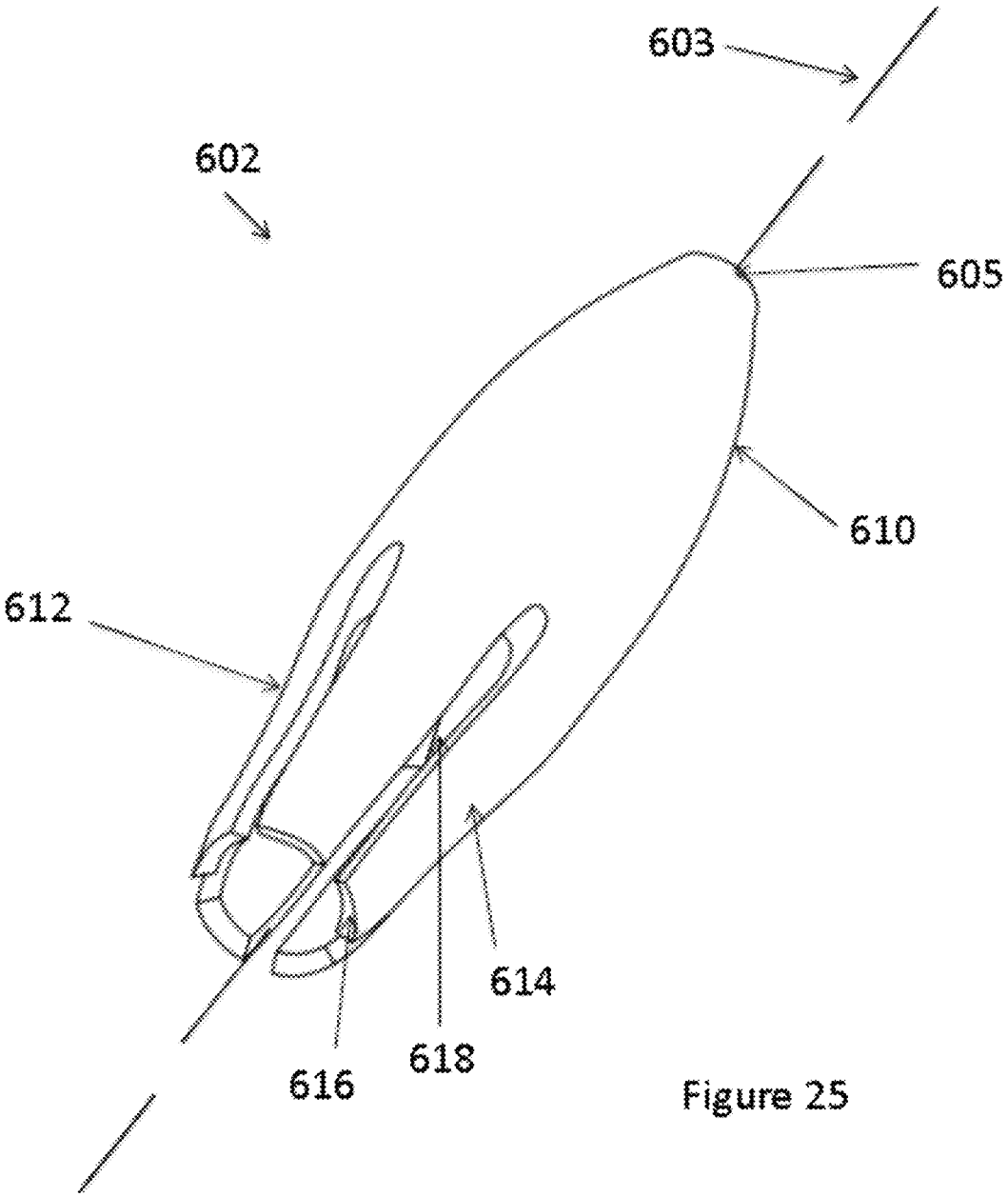
FIG. 25 is a top perspective view of the body of the fingertip mountable instrument shown in FIG. 24.
Figure 26:
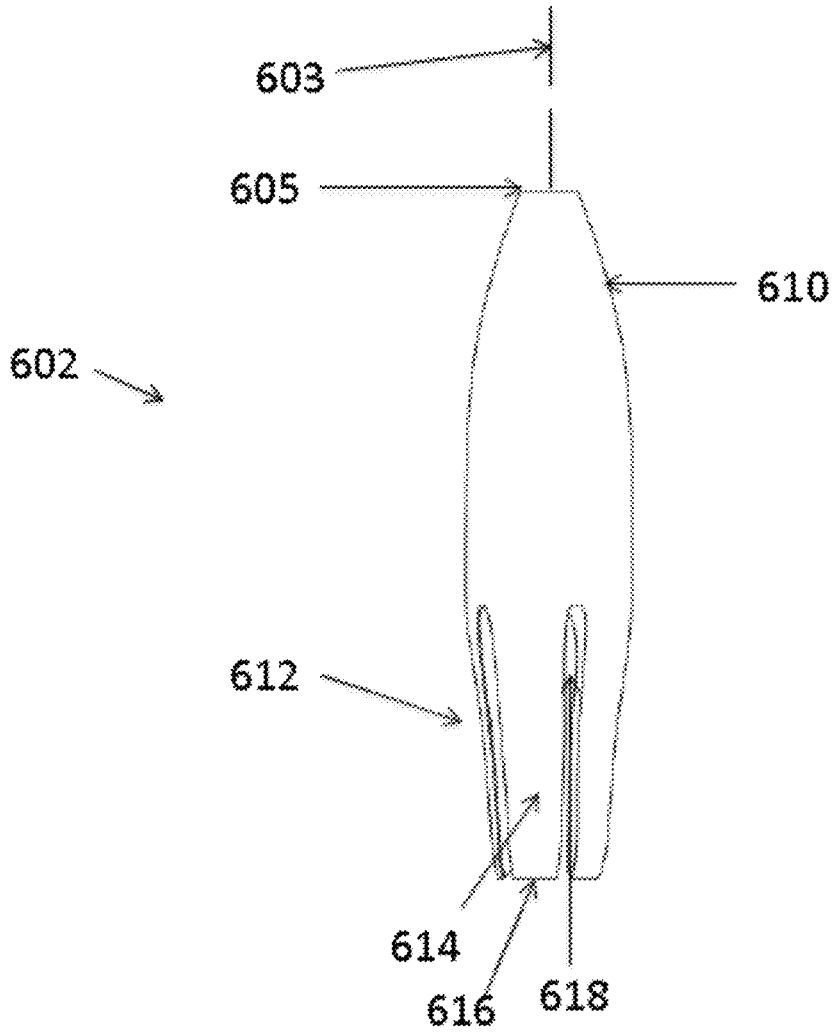
FIG. 26 is a side elevational view of the body of the fingertip mountable instrument shown in FIG. 24.
Figure 27:
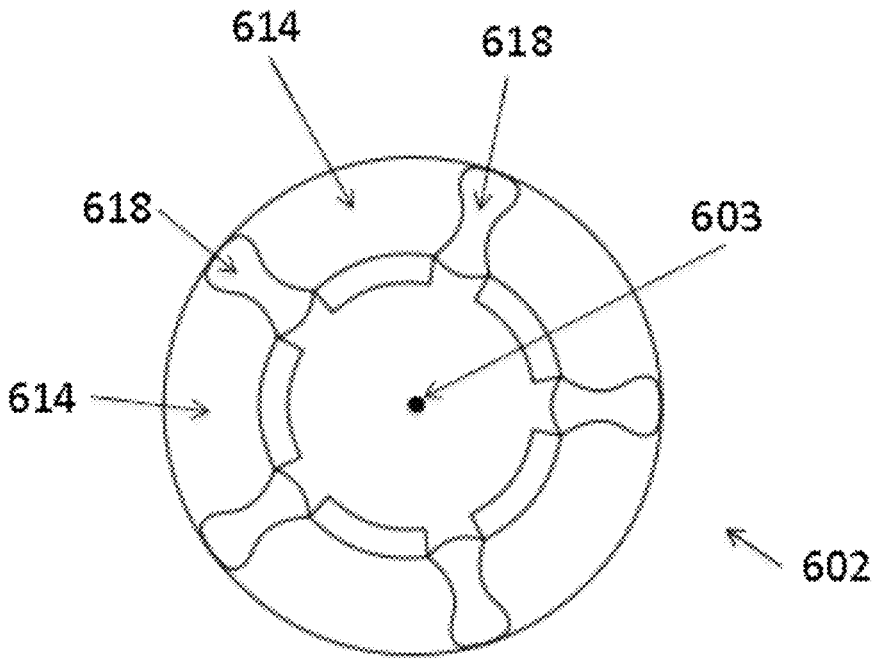
FIG. 27 is an end elevational view of the body of the fingertip mountable instrument shown in FIG. 24.

Referring to FIG. 23, ink reservoir portion 510 houses an ink reservoir 511 containing ink that diffuses from reservoir 511 to the writing tip via capillary action and/or gravity for writing. Ink reservoir portion 510 has a generally convex shape. A septum 513 separates the interior of ink reservoir portion 510 from finger engagement portion 512. Septum 513 has a generally flat wall 515 facing ink reservoir 511 and a generally concave wall 517 facing finger engagement portion 512.

Finger engagement portion 512 includes a plurality of finger engagement members 514 that extend radially around the circumference of finger engagement portion 512. In this embodiment, five finger engagement members 514 are spaced generally evenly around the circumference of finger engagement portion 512. Those skilled in the art, however, will recognize that more or less than five finger engagement members 514 can be used. In an exemplary embodiment, finger engagement portion 514 extends about 40% of the total length of body 502.

As shown in FIGS. 19-21 and 23, the top end 516 of each finger engagement member 514 is flared outwardly away from longitudinal axis 503. The outward flare facilitates insertion of a finger into finger engagement portion 512. Adjacent finger engagement members 514 are separated from each other by a gap 518 that allows each finger engagement member 514 to be biased outwardly, away from longitudinal axis 503, to allow a finger that is larger than the space inside finger engagement portion 512 to bias finger engagement members 514 outwardly and grip the finger. The five finger engagement members 514 provide sufficient force to grip the finger, but do not grip the finger so tight as to cause pain to the finger.

A sixth exemplary embodiment of a body 602 for a fingertip mountable writing instrument is shown in FIGS. 24-28. Body 602 includes a longitudinal axis 603 extending therethrough.

Body 602 is a generally elongated tubular shell having an ink reservoir portion 610 ending in a bottom end 605 and a finger engagement portion 612 into which the user's finger is inserted to use the writing instrument. Bottom end 605 retains a writing tip (not shown) thereon.

Figure 28:
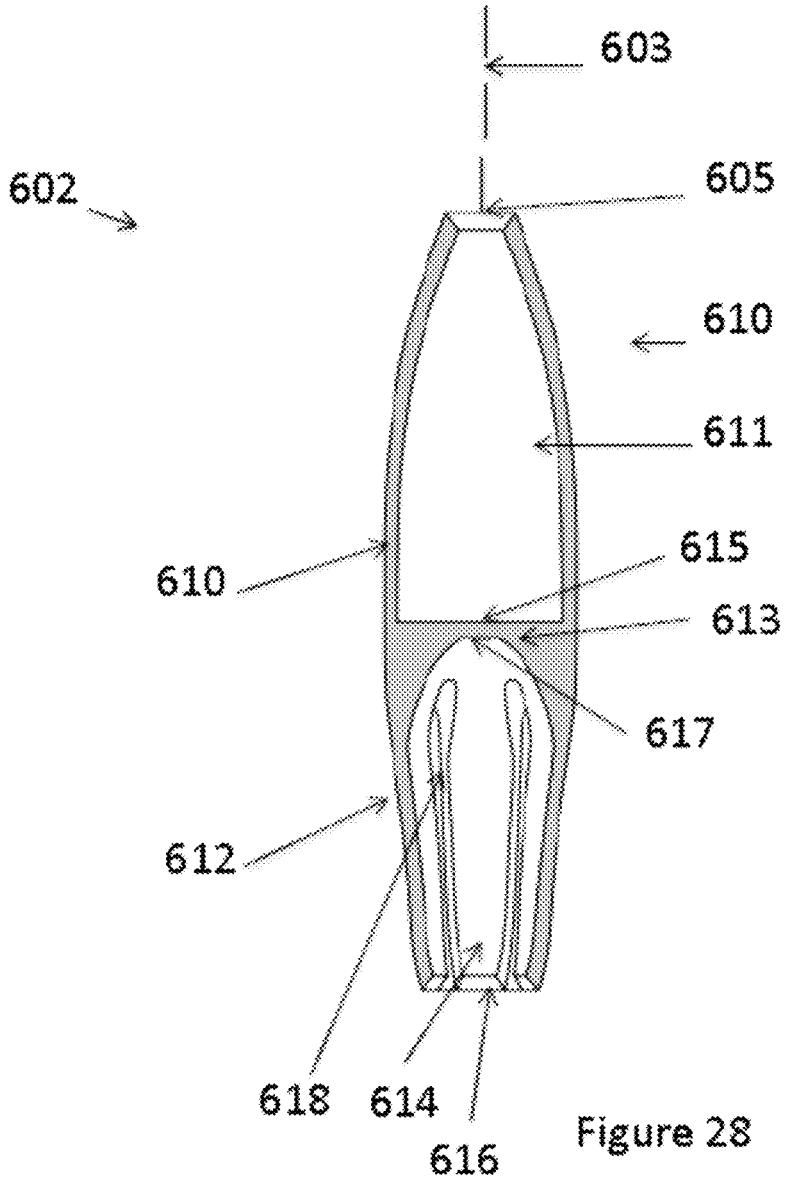
FIG. 28 is a sectional view of the body of the fingertip mountable instrument taken through lines 28-28 of FIG. 26.

Referring to FIG. 28, ink reservoir portion 610 houses an ink reservoir 611 containing ink that diffuses from reservoir 611 to the writing tip via capillary action and/or gravity for writing. Ink reservoir portion 610 has a generally convex shape. A septum 613 separates the interior of ink reservoir portion 610 from finger engagement portion 612. Septum 613 has a generally flat wall 615 facing ink reservoir 611 and a generally concave wall 617 facing finger engagement portion 612.

Finger engagement portion 612 includes a plurality of finger engagement members 614 that extend radially around the circumference of finger engagement portion 612. In this embodiment, five finger engagement members 614 are spaced generally evenly around the circumference of finger engagement portion 612. Those skilled in the art, however, will recognize that more or less than five finger engagement members 614 can be used. In an exemplary embodiment, finger engagement portion 514 extends about 45% of the total length of body 502.

The top end 616 of each finger engagement member 614 is flared inwardly away toward longitudinal axis 603. Adjacent finger engagement members 614 are separated from each other by a gap 618 that allows each finger engagement member 614 to be biased outwardly, away from longitudinal axis 603, to allow a finger that is larger than the space inside finger engagement portion 612 to bias finger engagement members 614 outwardly and grip the finger. The five finger engagement members 614 provide sufficient force to grip the finger, but do not grip the finger so tight as to cause pain to the finger.

Figure 29:
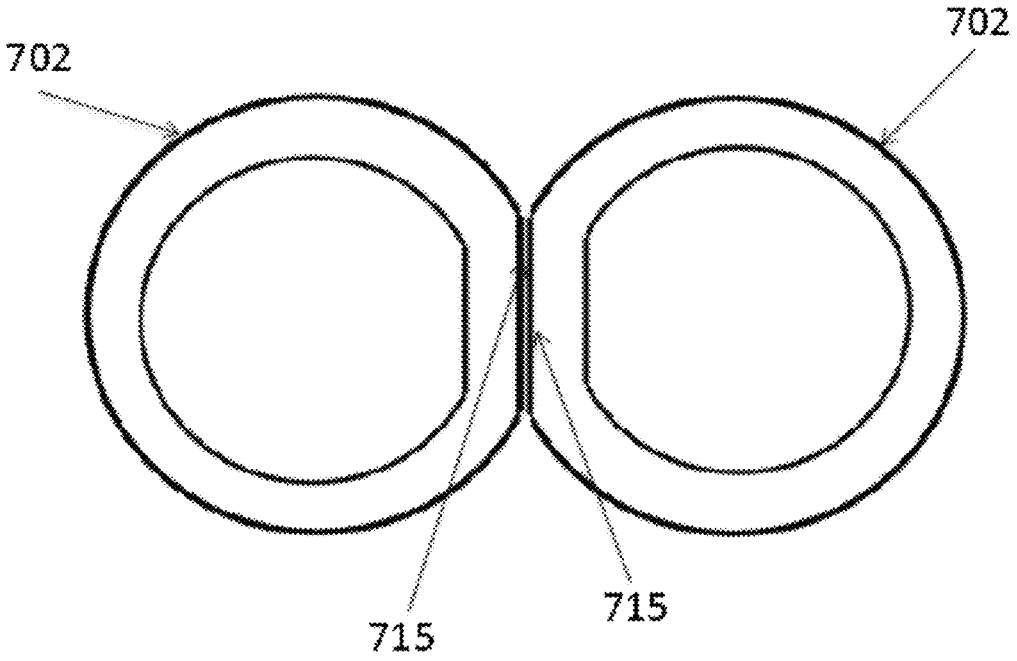
FIG. 29 is an end elevational view of the bodies of two adjacent fingertip mountable instruments according to a seventh exemplary embodiment of the present invention.

A seventh exemplary embodiment of a body 702 for a fingertip mountable writing instrument is shown in FIG. 29. Body 702 is similar to body 102, 202, 302, 402, 502, and 602 except, instead of having a generally circular transverse cross-section in each of reservoir portion 110, 210, 310, 410, 510, and 610, reservoir portion 710 has a least one side 715 that allows two bodies 702, 702' to be aligned next to each other so that flat sides 715, 715' engage each other. Such a configuration allows body 702 to be inserted over an index finger and body 702' to be inserted over a middle finger on the same hand, thereby allowing the user to use two writing implements simultaneously and keep the writing tips of the two implements a constant distance from each other.

An eighth exemplary embodiment of a writing instrument 800 according to the present invention is shown in FIGS. 30-36. As with all of the other exemplary embodiment, described above, writing instrument 800 can be a felt tip marker, an ink pen, a pencil, or any other type of writing instrument.

Writing instrument 800 includes a bifurcated body 802 extending along a central axis 804. Body 802 has a distal writing tip 810 located on a first side 822 of a tubular bifurcation 820 and a proximal end 830 located on a second side 824 of bifurcation 820, distal from distal writing tip 810. If writing instrument 800 is a felt tip marker or an ink pen, and ink supply (not shown) is provided inside distal tip 800, 10, and bifurcation 820.

Distal writing tip 810 has a frustoconical end 812 and a tubular portion 814 extending proximally from frustoconical end 812. Tubular portion 814 has a larger diameter than frustoconical end 812. Tubular portion 814 has a circumferential ridge 816 adjacent frustoconical end 812.

Figure 36:
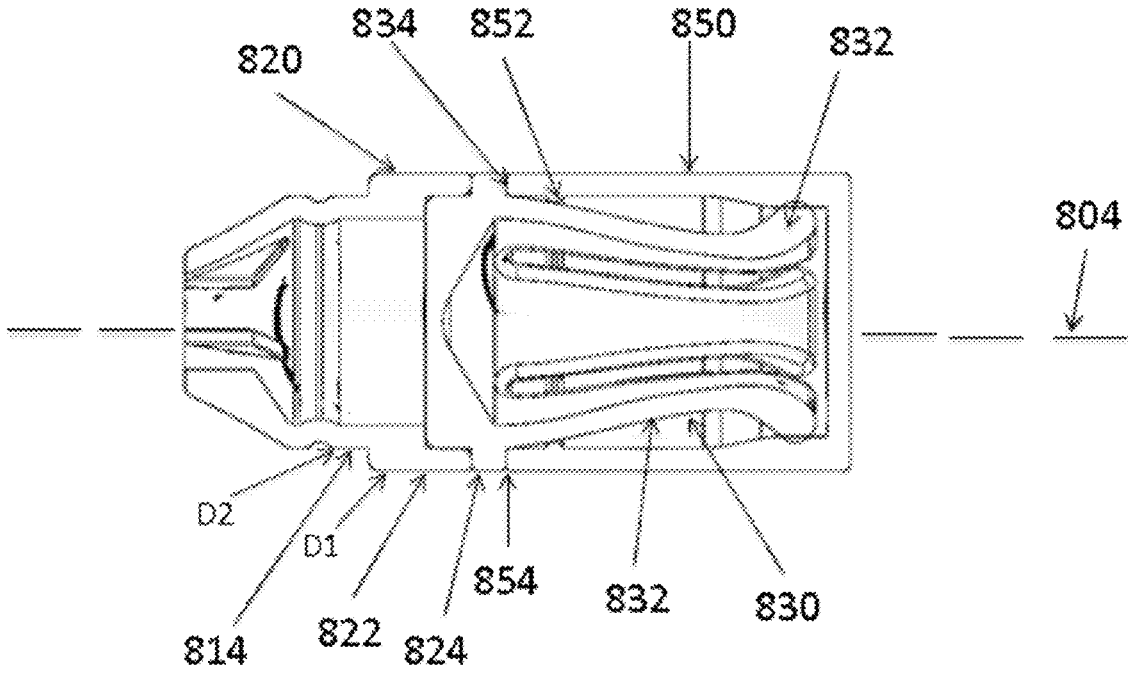
FIG. 36 is a sectional view of the fingertip mountable writing instrument shown in FIG. 35, taken along lines 36-36 of FIG. 35.

Referring to FIG. 36, bifurcation 820 has a diameter D1 larger than the diameter D2 of tubular portion 814. Bifurcation 820 includes a distal end 822 that is fixedly connected to a proximal end 824. Such connection can be an interference fit, a snap fit, ultrasonic welding, or other suitable fixed connection mechanism.

Proximal end 830 includes a plurality of fingers 832 extending proximally from proximal end 824 of bifurcation 820. Each of the plurality of fingers 832 extends toward and is biased toward central axis 804. In an exemplary embodiment, five fingers 832 are provided, although those skilled in the art will recognize that more or less than five fingers 832 can be provided.

Each of the plurality of fingers 832 includes a distal end 834 connected to bifurcation 820 and spaced a first distance from central axis 804. A medial portion 836 of finger 832 extends proximally from distal end 834 and is spaced a second distance from central axis 804, less than the first distance, meaning that medial portion 836 is closer to central axis 804, than distal end 834. Each finger 832 further includes a proximal end 838 that extends proximally from medial portion 836 and is spaced a third distance from central axis 804, greater than the second distance, meaning that proximal end 838 is farther from central axis 804 than medial portion 836. However, proximal end 838 extends closer to central axis 804 than diameter D1 of bifurcation 820. This allows a cap 850 to be slid over fingers 832, if desired.

Distal end 834 and medial portion 836 extend linearly from proximal end 824 of bifurcation and finger 832 then curves outwardly toward proximal end 838 of finger 832. The inventor believes that the linear extension of fingers 832 provides a sufficient grip onto a user's finger to securely maintain writing instrument 800 onto a user's finger.

Figure 32:
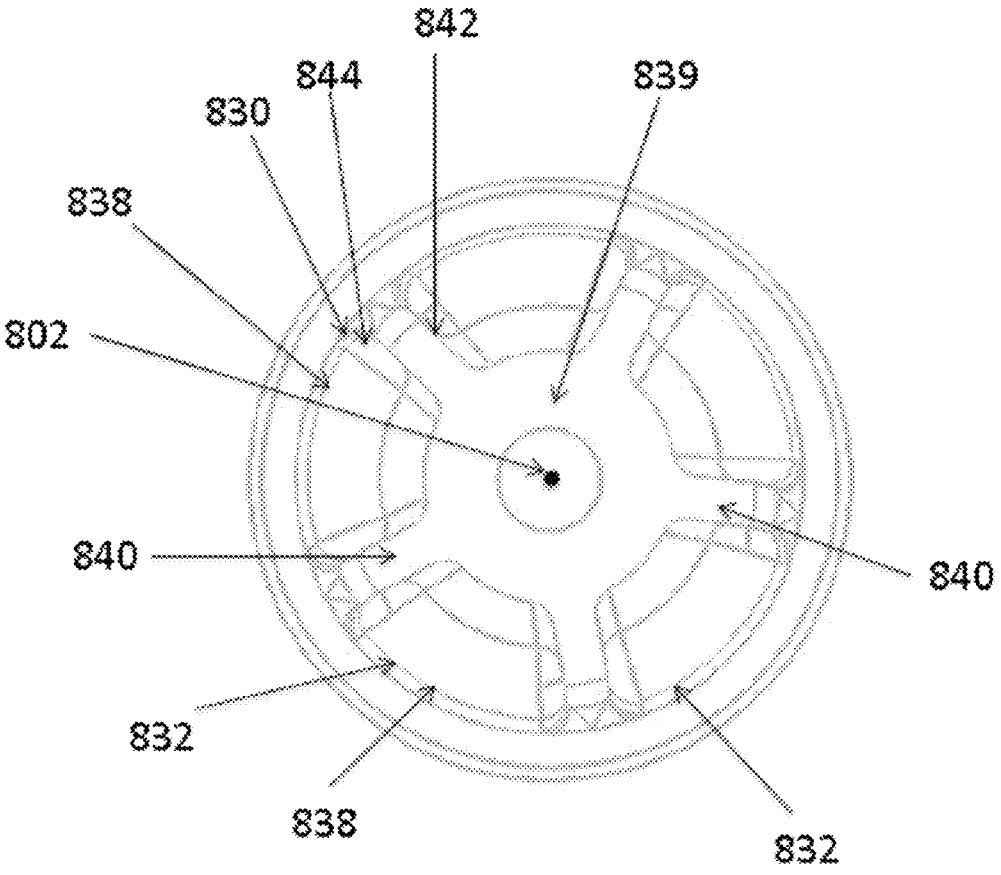
FIG. 32 is an end view of the fingertip mountable writing instrument shown in FIG. 30, taken along lines 32-32 of FIG. 30.
Figure 33:
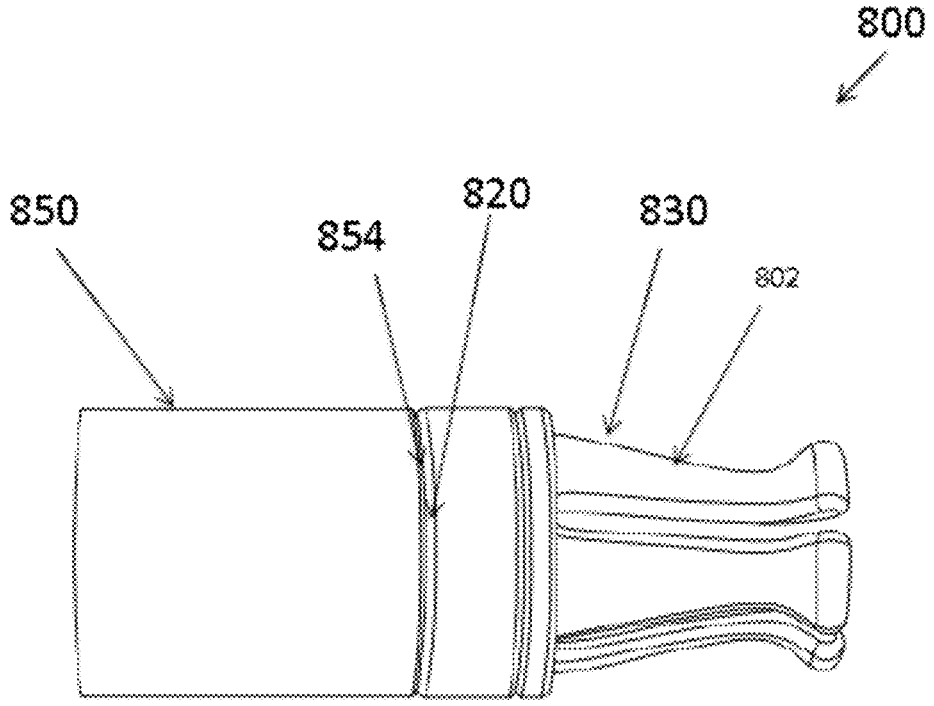
FIG. 33 is a side elevational view of the fingertip mountable writing instrument shown in FIG. 30, with a cap releasably connected to a distal tip of the writing instrument.
Figure 34:
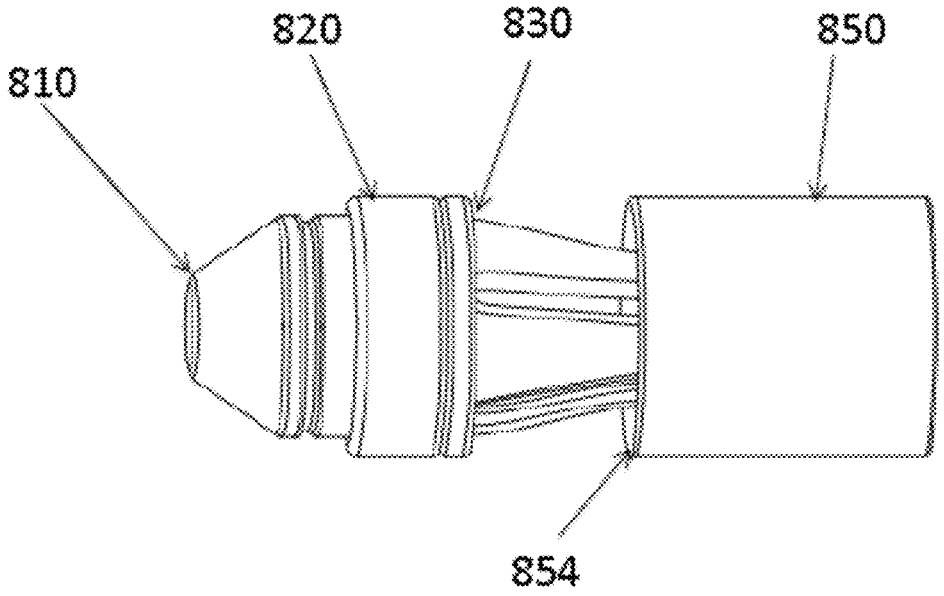
FIG. 34 is a side elevational view of the fingertip mountable writing instrument shown in FIG. 30, with the cap being inserted on a proximal end of the writing instrument.

Referring to FIG. 32, proximal end 830 includes a finger insertion cavity 839 extending along central axis 802 and defined by the plurality of fingers 832. Each of fingers 832 has an arcuate length at proximal end 838 surrounding finger insertion cavity 839. Distal end 830 further comprises a slot 840 extending axially between each of the plurality of fingers 832. Each of the plurality of slots 840 has a slot arcuate length, less than the arcuate length at proximal end 838 of each of the plurality of fingers 832. Further, a sidewall 842 of one of the plurality of fingers 832 on a first side of slot 840 extends parallel to a sidewall 844 of an adjacent of the plurality of fingers 832 on a second side of slot 840.

Figure 30:
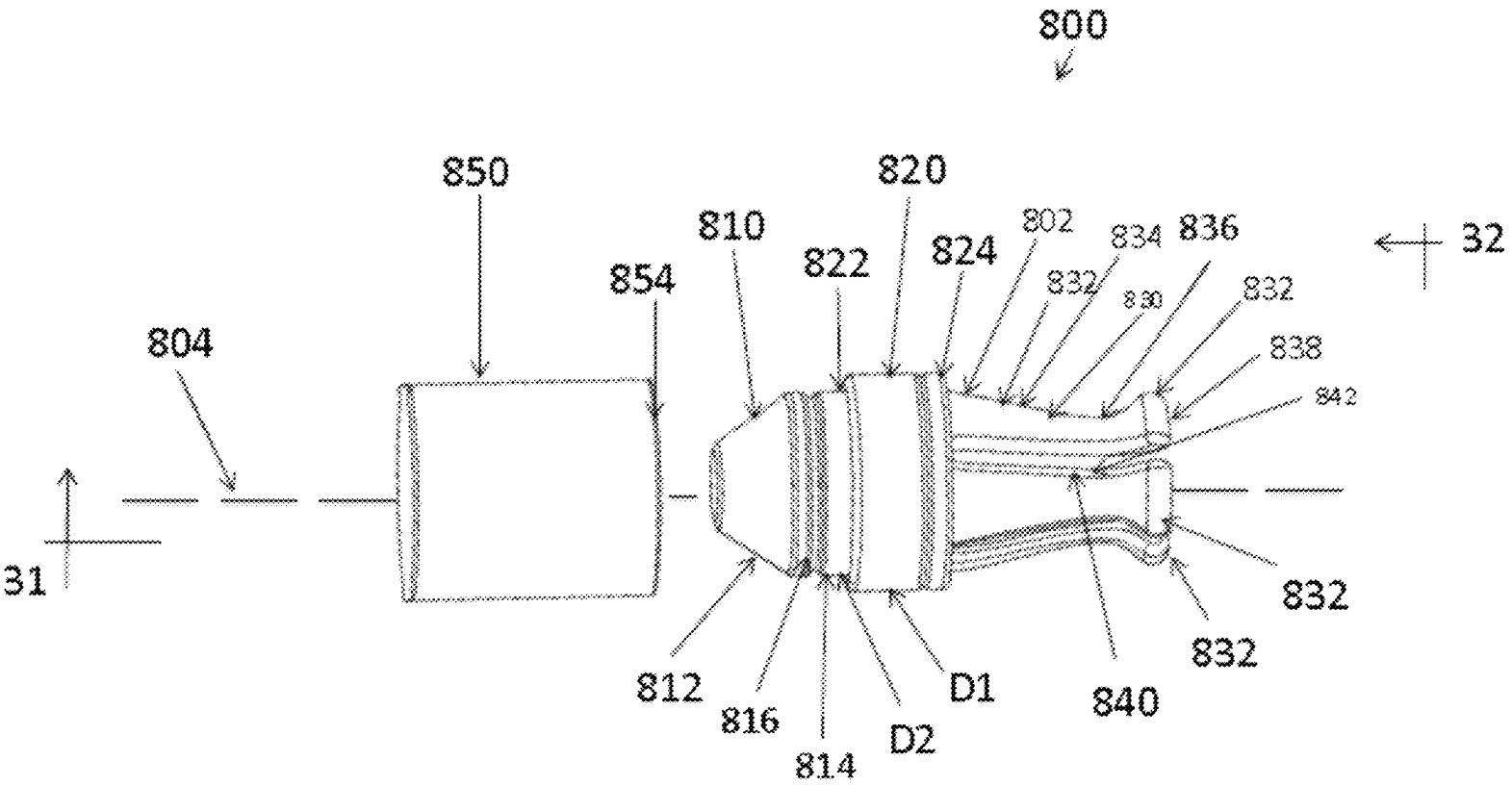
FIG. 30 is a side elevational view of a fingertip mountable writing instrument according to an eighth exemplary embodiment, the present invention.
Figure 31:
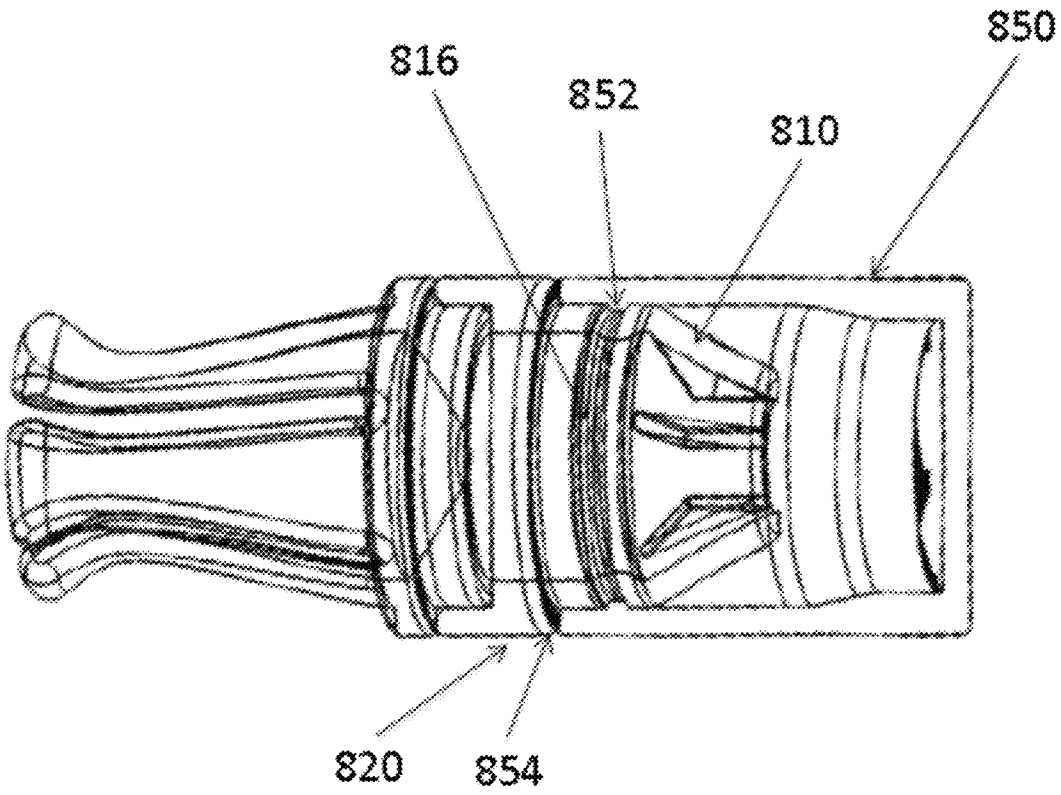
FIG. 31 is a sectional view of the fingertip mountable writing instrument shown in FIG. 30, taken along lines. 31-31 of FIG. 30.
Figure 35:
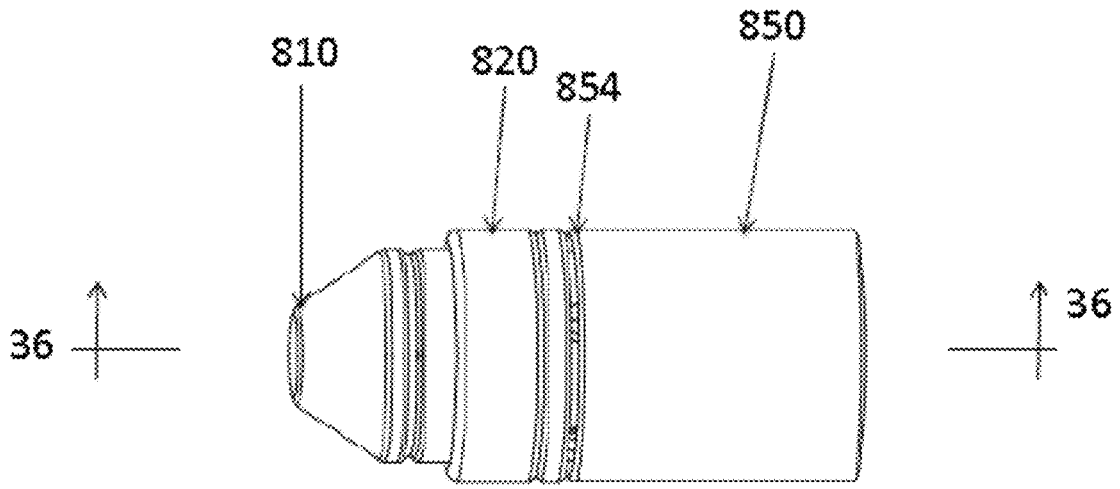
FIG. 35 is a side elevational view of the fingertip mountable writing instrument shown in FIG. 30, with the cap having been inserted on the proximal end of the writing instrument.

Referring to FIGS. 30, 31 and 35, a cap 850 is releasably connectable to body 802 at either one of the distal writing tip 810 and proximal end 830. Cap 850 includes an interior rib 852 extending circumferentially therealong. Rib 852 is sized to releasably engage circumferential ridge 816 when cap 850 is disposed over distal writing tip 810.

Referring to FIG. 36, rib 852 engages distal end 834 of each of the plurality of fingers 832 when cap 850 is connected to proximal end 830. Cap 850 also includes an open end 854. When cap 850 is connected to distal writing tip 810, open end 854 engages bifurcation 820 (as shown in FIG. 31). When cap 850 is connected to proximal end 830, open end 854 also engages bifurcation 820 (as shown in FIG. 36).

Figure 37:
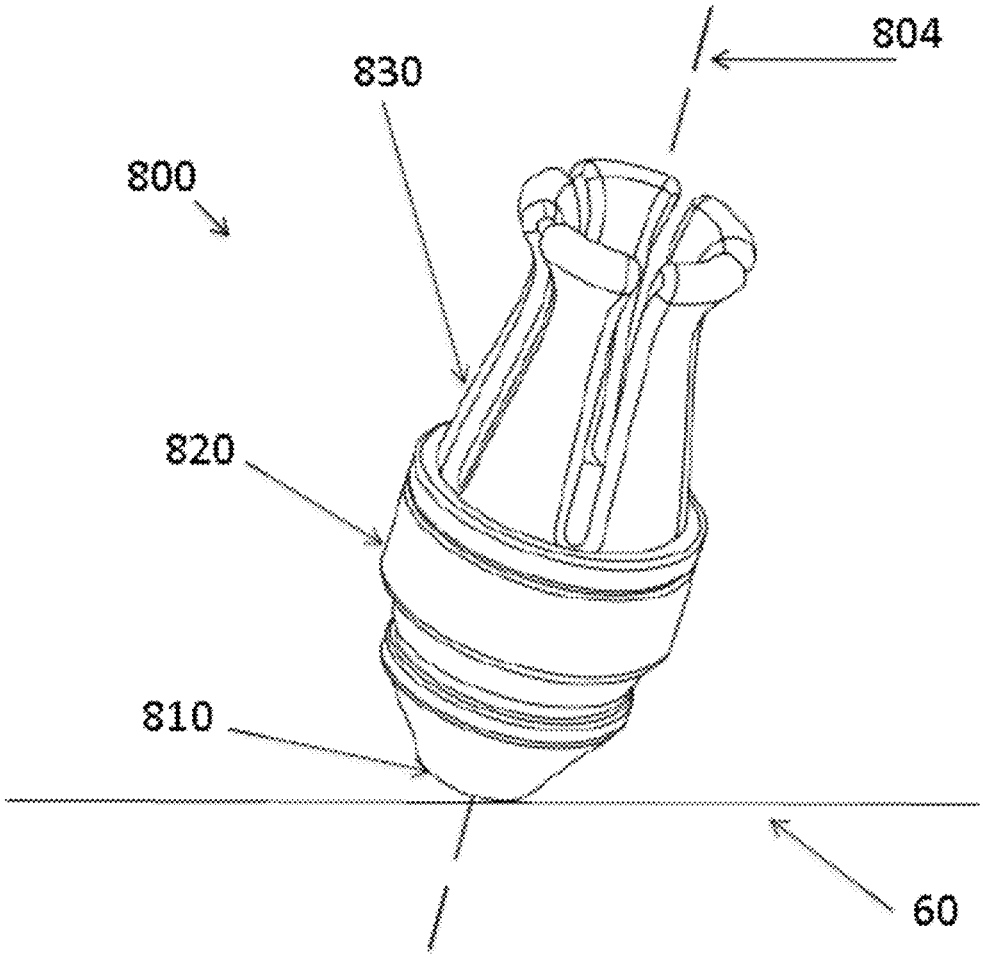
FIG. 37 is a perspective view showing the fingertip mountable writing instrument shown in FIG. 30 being used with a finger inserted therein.

To use writing instrument 800, a user can hold writing instrument 800 according to at least one of the following methods. Referring to FIG. 37, in a first method, the user inserts a finger 50 into proximal end 830 along central axis 804 and engages distal writing tip 810 against a writing surface 60. Insertion of finger 50, forces fingers 832 away from central axis 804. The bias of fingers 832 toward central axis 804 grips finger 50 and retains writing instrument 800 onto finger 50 so that the user can write with writing instrument. 100.

Figure 38:
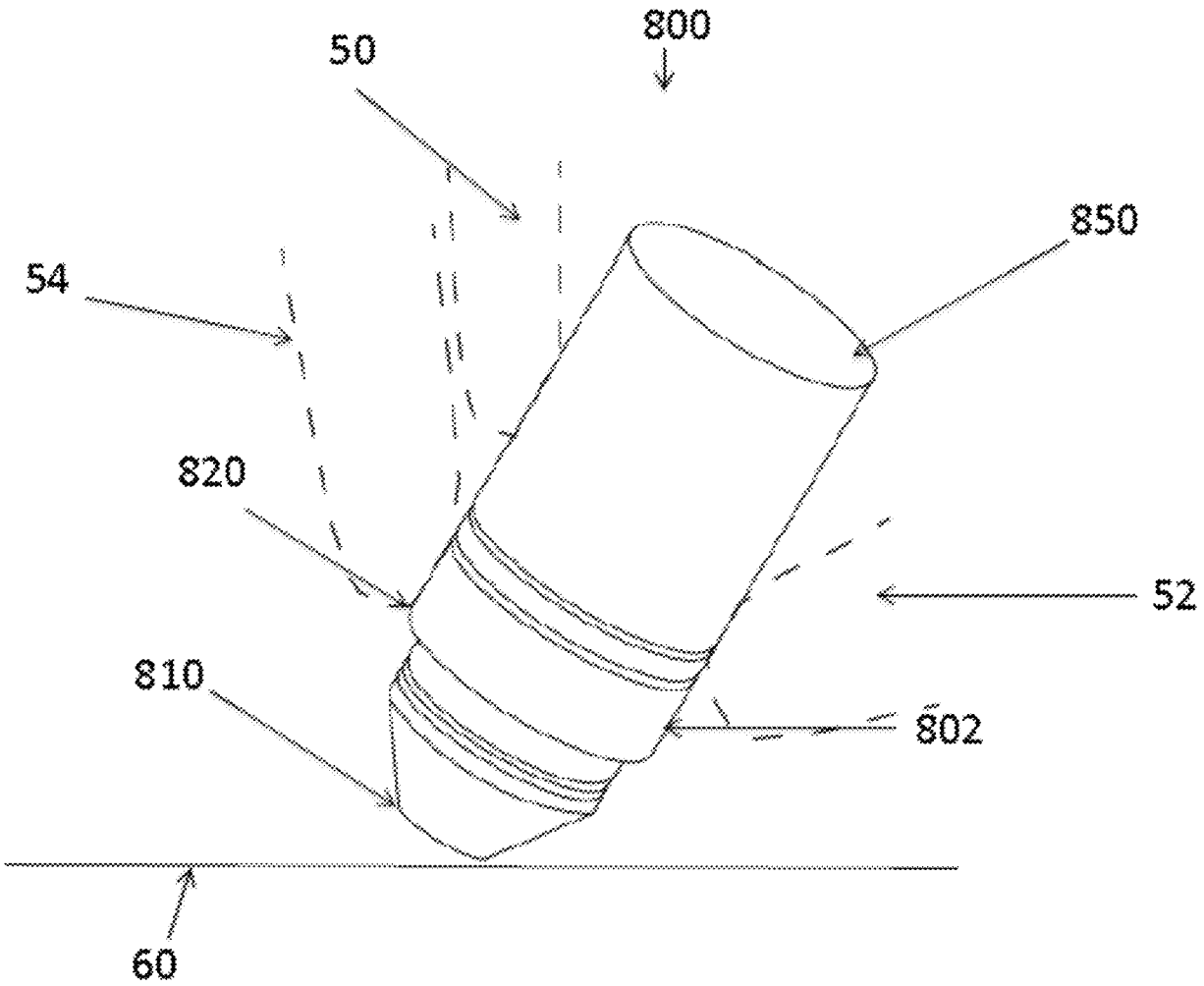
FIG. 38 is a perspective view showing the fingertip mountable writing instrument shown in FIG. 30 being used by gripping the instrument between a thumb and fingers.

Alternatively, referring to FIG. 38, a user can grip bifurcation 820 between a thumb 52 and two adjacent fingers 50, 54, such as, for example, the index and middle fingers) and engages distal writing tip it hundred and 10 against writing surface 60. Optionally, as shown FIG. 38, prior to gripping writing instrument 800, with some 52 and adjacent fingers 50, 54, cap 850 can be releasably connected to body 802 by inserting cap 850 over the plurality of fingers 832.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A writing instrument comprising:

a body extending along a central axis, the body having a tubular member and a distal writing tip located on a first side of the tubular member and a proximal end located on a second side of the tubular member, distal from the distal writing tip; and a cap releasably connectable to the body at either one of the distal writing tip and the proximal end, wherein the cap includes an interior rib extending circumferentially therealong, the rib being sized to releasable engage the circumferential ridge when the cap is connected to the distal writing tip, and wherein the rib engages the distal end of each of the plurality of fingers when the cap is connected to the proximal end, wherein the distal writing tip has a frustoconical end and a tubular portion extending proximally from the frustoconical end, the tubular portion having a circumferential ridge adjacent the frustoconical end;

wherein the body has a diameter larger than the diameter of the tubular portion; and wherein the proximal end includes a plurality of fingers extending proximally from the body, each of the plurality of fingers being biased toward the central axis.

2. The writing instrument according to claim 1, wherein each of the plurality of fingers includes a distal end connected to the body spaced a first distance from the central axis and a medial portion extending proximally from the distal end and spaced a second distance from the central axis, less than the first distance.

3. The writing instrument according to claim 2, wherein each of the plurality of fingers further includes a proximal end extending proximally from the medial portion and spaced a third distance from the central axis, greater than the second distance.

4. The writing instrument according to claim 2, wherein each of the fingers has an arcuate length at the proximal end thereof, and wherein the distal end further comprises a slot extending axially between each of the plurality of fingers, each of the plurality of slots has a slot arcuate length, less than the arcuate length at the proximal end of each of the plurality of fingers.

5. The writing instrument according to claim 1, wherein the proximal end further includes a slot extending between each of the plurality of fingers, wherein a sidewall of one of the plurality of fingers on a first side of the slot extends parallel to a sidewall of an adjacent of the plurality of fingers on a second side of the slot.

6. The writing instrument according to claim 1, wherein the cap comprises an open end, wherein, when the cap is connected to the distal writing tip, the open end engages the body and, when the cap is connected to the proximal end, the open end engages the body.

7. The writing instrument according to claim 1, wherein the proximal end comprises a finger insertion cavity extending along the central axis and defined by the plurality of fingers.

8. A method of writing comprising the steps of:

(a) providing the writing instrument according to claim 1; and (b) holding the writing instrument according to either of the following methods:

(i) inserting a finger into the proximal end along the central axis and engaging the distal writing tip against a writing surface;

(ii) inserting the cap over the plurality of fingers; and (iii) gripping the central body between a thumb and two adjacent fingers and engaging the distal writing tip against a writing surface.

9. A writing instrument comprising:

a body extending along a central axis, the body having:

a distal end;

a central portion attached to a proximal end of the distal end, the central portion having a larger diameter than the distal end; and a proximal end having a plurality of fingers extending proximally from the central portion, each of the plurality of fingers being biased toward the central axis; and a cap alternatively removably connectable to the distal end of the body and engageable with the central portion and removably connectable over the proximal end of the body and engageable with the central portion.

10. The writing instrument according to claim 9, wherein the distal end comprises a writing end and a tubular portion extending proximally from the writing end.

11. The writing instrument according to claim 10, wherein the tubular portion has a circumferential ridge adjacent the writing end.

12. The writing instrument according to claim 10, wherein the writing end is frustoconical in shape.

* * * * *